US008678920B2

(12) United States Patent
Yacenda

(10) Patent No.: US 8,678,920 B2
(45) **Date of Patent: *Mar. 25, 2014**

(54) INTERACTIVE COMPUTER GAMING SYSTEM WITH AUDIO RESPONSE

(75) Inventor: Michael W. Yacenda, Stamford, CT (US)

(73) Assignee: Elottery, Inc., Stamford, CT (US)

( * ) Notice: Subject to any disclaimer, the term of this patent is extended or adjusted under 35 U.S.C. 154(b) by 217 days.

This patent is subject to a terminal disclaimer.

(21) Appl. No.: 13/275,387

(22) Filed: Oct. 18, 2011

(65) Prior Publication Data

US 2012/0034963 A1 Feb. 9, 2012

Related U.S. Application Data

(63) Continuation of application No. 10/441,587, filed on May 19, 2003, now Pat. No. 8,272,959, which is a continuation-in-part of application No. 09/150,003, filed on Sep. 8, 1998, now abandoned, which is a continuation-in-part of application No. 08/970,375, filed on Nov. 14, 1997, now abandoned.

(51) Int. Cl.
*G07F 17/32* (2006.01)

(52) U.S. Cl.
USPC ..... 463/29; 463/16; 463/20; 463/25

(58) Field of Classification Search
USPC ..... 463/16, 20, 25, 42, 29
See application file for complete search history.

(56) References Cited

U.S. PATENT DOCUMENTS

| | | | |
|---|---|---|---|
| 4,713,837 | A | 12/1987 | Gordon |
| 4,815,741 | A | 3/1989 | Small |
| 4,842,278 | A | 6/1989 | Markowicz |

(Continued)

FOREIGN PATENT DOCUMENTS

| | | |
|---|---|---|
| WO | WO 95/10098 | 4/1995 |
| WO | WO 01/18759 | 3/2001 |
| WO | WO 01/70359 | 9/2001 |
| WO | WO 01/71677 | 9/2001 |

OTHER PUBLICATIONS

USPTO Office Action Dated May 5, 2012 for U.S. Appl. No. 10/441,587.

(Continued)

*Primary Examiner* — Omkar Deodhar
(74) *Attorney, Agent, or Firm* — F. Chau & Associates, LLC

(57) ABSTRACT

A remotely accessed lottery system in accordance with the present invention, includes at least one gaming location including a plurality of terminals, each terminal including a display and an input device, the terminals being connected on a local area network. A dedicated transmission link is coupled to the local area network. A central station is remotely disposed relative to the at least one gaming location, the central station coupled to the local area network by the dedicated transmission link. The central station further includes at least one computer for generating tickets to be sent to the terminals pursuant to requests by players to participate, wherein the tickets are digitally rendered on a display of the terminals and have outcomes predetermined at the central station prior to the request for purchase and also includes a device for updating player accounts responsive to requests for participation and winning results as determined at the central station. A method for playing virtual scratch off games is also included.

24 Claims, 21 Drawing Sheets

(56) References Cited

U.S. PATENT DOCUMENTS

| | | | | |
|---|---|---|---|---|
| 4,856,787 | A * | 8/1989 | Itkis | 273/237 |
| 4,922,522 | A | 5/1990 | Scanlon | |
| 5,119,295 | A | 6/1992 | Kapur | |
| 5,276,312 | A | 1/1994 | McCarthy | |
| 5,326,104 | A | 7/1994 | Pease et al. | |
| 5,354,069 | A | 10/1994 | Guttman et al. | |
| 5,415,416 | A | 5/1995 | Scagnelli et al. | |
| 5,417,424 | A | 5/1995 | Snowden et al. | |
| 5,505,449 | A | 4/1996 | Eberhardt et al. | |
| 5,569,082 | A | 10/1996 | Kaye | |
| 5,674,128 | A * | 10/1997 | Holch et al. | 463/42 |
| 5,800,269 | A | 9/1998 | Holch et al. | |
| 5,816,918 | A * | 10/1998 | Kelly et al. | 463/16 |
| 5,816,919 | A | 10/1998 | Scagnelli et al. | |
| 5,954,582 | A | 9/1999 | Zach | |
| 5,979,894 | A | 11/1999 | Alexoff | |
| 6,017,032 | A | 1/2000 | Grippo et al. | |
| 6,024,641 | A | 2/2000 | Sarno | |
| 6,080,062 | A | 6/2000 | Olson | |
| 6,086,477 | A | 7/2000 | Walker et al. | |
| 6,102,400 | A | 8/2000 | Scott et al. | |
| 6,146,272 | A | 11/2000 | Walker et al. | |
| 6,154,172 | A | 11/2000 | Piccionelli et al. | |
| 6,168,521 | B1 | 1/2001 | Luciano et al. | |
| 6,183,361 | B1 | 2/2001 | Cummings et al. | |
| 6,251,016 | B1 | 6/2001 | Tsuda et al. | |
| 6,277,026 | B1 | 8/2001 | Archer | |
| 6,322,446 | B1 | 11/2001 | Yacenda | |
| 6,383,078 | B1 | 5/2002 | Yacenda | |
| 6,599,186 | B1 | 7/2003 | Walker et al. | |
| 6,869,358 | B2 | 3/2005 | Yacenda | |
| 6,874,783 | B2 | 4/2005 | Higginson et al. | |
| 7,931,529 | B2 | 4/2011 | Yacenda | |
| 8,272,959 | B2 * | 9/2012 | Yacenda | 463/42 |
| 2001/0003100 | A1 | 6/2001 | Yacenda | |
| 2001/0031661 | A1 | 10/2001 | Wiltshire et al. | |
| 2002/0147049 | A1 | 10/2002 | Carter, Sr. | |
| 2003/0023547 | A1 | 1/2003 | France et al. | |
| 2004/0259626 | A1 | 12/2004 | Akram et al. | |
| 2005/0153779 | A1 | 7/2005 | Ziegler | |
| 2005/0215306 | A1 | 9/2005 | O'Donnell et al. | |
| 2007/0060284 | A1 | 3/2007 | Yecenda | |

OTHER PUBLICATIONS

US 5,823,877, 10/1998, Scagnelli et al. (withdrawn).
International Search Report dated Sep. 22, 2009.
Statement of Ground and Particulars in Support of Opposition dated Oct. 2, 2009 by South Wales Lotteries Corporation.
Statement of Grounds and Particulars in Support of Opposition dated Sep. 25, 2009 by Manaccom Corporation Ltd.
Dreams Come true website (www.dreamscometrue.com.au).

* cited by examiner

ENHANCED GAMES

MAY STK 2045 ACCOUNT# 2122543298

"SUPER LOTTO"
TRY AGAIN

| | | | | | | | | | |
|---|---|---|---|---|---|---|---|---|---|
| 1 | 2 | 3 | 4 | 5 | 6 | 7 | 8 | 9 | 10 |
| 11 | 12 | 13 | | 15 | 16 | 17 | 18 | 19 | 20 |
| 21 | 22 | 23 | 24 | 25 | 26 | 27 | 28 | 29 | 30 |
| 31 | 32 | 33 | 34 | 35 | 36 | 37 | 38 | 39 | 40 |

| | | | | | | | | | |
|---|---|---|---|---|---|---|---|---|---|
| 41 | 42 | 43 | 44 | 45 | 46 | 47 | 48 | 49 | 50 |
| 51 | 52 | 53 | 54 | 55 | 56 | 57 | 58 | 59 | 60 |
| 61 | 62 | 63 | 64 | 65 | 66 | 67 | 68 | 69 | 70 |
| 71 | 72 | 73 | 74 | 75 | 76 | 77 | 78 | 79 | 80 |

THANK YOU FOR PLAYING
PLAY AGAIN SOON!

INTERACTIVE COMPUTER GAMING SYSTEM WITH AUDIO RESPONSE

RELATED APPLICATION DATA

This application is a continuation of application U.S. Ser. No. 10/441,587, filed on May 19, 2003, now U.S. Pat. No. 8,272,959 which in turn is a continuation-in-part of application U.S. Ser. No. 09/150,003, filed on Sep. 8, 1998, now abandoned which in turn is a continuation-in-part of application U.S. Ser. No. 08/970,375, filed on Nov. 14, 1997 now abandoned. The disclosures of the above-referenced application are incorporated by reference herein in their entireties.

BACKGROUND

1. Technical Field

This disclosure relates to gaming systems and more particularly, to a personal computer and telephone interactive system with audio response and method.

2. Discussion of the Related Art

It is typical for state lottery systems to provide agents to input a selection of lottery numbers into a lottery system database. Lottery players are often required to visit a local lottery agent located in public facilities and in some instances wait in line in order to participate in the lottery.

Several solutions have been proposed for a remote access gaming system in which lottery number selection can be entered by telephone. One such system and method is described in U.S. Pat. No. 4,922,522 to John M. Scanlon (Scanlon). Scanlon describes a customer interactive gaming system for periodically entering lottery number selections into the lottery database from a customer station over the public switched telephone network (PSTN). Another system is described in U.S. Pat. No. 5,415,416 to Scagnelli et al. Scagnelli et al. describes a wagering system which includes an autocall director unit (ACU) which routes calls to various voice response units depending on caller response data entered by pressing numbers on a phone keypad.

An improved gaming system for either computer users or telephone users could be achieved if the system offered audio response over a telephone or computer network such as the Internet during game play. A more realistic and entertaining game could be achieved. The above mentioned patents do not describe systems having audio responses sent to the player over the Internet. Further, it would be advantageous to provide local area network connections from voice response units and the gaming system servers instead of a private branch exchange link, as described in the above patents because the number of lines needed for a Private Branch Exchange (PBX) can be prohibitive for high call volume systems.

Therefore, a need exists for a real time interactive gaming system which provides visual as well as audio response during game play. Further, it would be advantageous to provide both personal computer and telephone assistance simultaneously for players experiencing difficulties or needing other assistance. Further, a need exists for a method and apparatus for an interactive computer gaming system which provides appealing and user friendly, interfaces including sound and video to the games remotely from a server.

SUMMARY OF THE INVENTION

A remotely accessed gaming system is provided which includes a plurality of terminals including a computer having a modem connecting to a telephone network or system. A plurality of voice response units, each connecting to the telephone system for providing prompts to the terminals and responses to information entered from the terminals is also included. A local area network connects the plurality of voice response units, and a business server connects to the local area network for receiving and processing subscriber information and providing access to a gaming computer for remote gaming from the plurality of terminals.

In other illustrative embodiments, the gaming system may include a lottery computer for playing a lottery game. The lottery computer may include memory for storing at least one set of lottery numbers to be reserved for a subscriber for a predetermined period of time such that the subscriber participates in predetermined lottery drawings for the predetermined period of time. The gaming computer may include at least one computer for playing a plurality of games. The plurality of terminals may each include a telephone for accessing the gaming computer. The business server may be accessed from the plurality of terminals via the Internet. The business server may include a memory for storing account and subscriber information. The gaming computer may send audio signals to the plurality of terminals which are converted to sound by a sound card and speaker system within the computer. The business server may maintain a subscriber account balance which is debited when a wager is placed and credited if winnings are realized. The subscriber account may be credited from a credit card account.

A method of playing games remotely includes the steps of providing a remotely accessed gaming system which includes a plurality of terminals including a computer having a modem connecting to a telephone system, a plurality of voice response units, each for connecting to the telephone system for providing prompts to the terminals and responses to information entered from the terminals, a local area network connecting to the plurality of voice response units, and a business server connecting to the local area network for receiving and processing subscriber information and providing access to a gaming computer for remote gaming from the plurality of terminals. Also included are the steps of receiving entry data entered by a subscriber from the plurality of terminals, accessing the gaming computer through the business server and interacting with the gaming computer to play a game.

In other illustrative methods, the plurality of terminals includes a telephone for interacting with the gaming computer and the business server. The step of receiving entry data may further include entering a personal identification number and an account number from the plurality of terminals and selecting an option from a group of options from the plurality of terminals. The step of selecting an option may further include selecting a play option from a group of options from the plurality of terminals, selecting a game from a group of games from the plurality of terminals and entering gaming information from the plurality of terminals. The step of selecting an option may further include selecting an account balance option from a group of options from the plurality of terminals and entering account information from the plurality of terminals. The game may be a lottery drawing and the step of selecting an option may include selecting a ticket confirmation option from a group of options from the plurality of terminals and entering ticket information from the plurality of terminals to receive a ticket confirmation.

In still other methods, the step of accessing the business server may include accessing a memory of the business server to debit or credit a subscriber account having a balance, debiting the subscriber account by participating in a game and crediting the subscriber account if winnings are realized. The step of debiting a subscriber credit card account to credit the subscriber account may be included. The game may be a lottery and the step of interacting with the gaming computer to play a game may include entering a number of lottery games from the plurality of terminals, entering an appropriate number of number selections for each lottery game, confirming the number selections and debiting a subscriber account for the cost of participation. The number selection may be selected by the gaming computer. The lottery may be an instant lottery and may include the steps of comparing the number selections to a set of lottery drawn numbers, notifying a subscriber if winnings are realized and crediting the subscriber account with the winnings. The step of notifying a subscriber if winnings are realized may also be included.

A remotely accessed lottery system in accordance with the present invention includes at least one gaming location including a plurality of terminals, each terminal including a display and an input device, the terminals being connected on a local area network. A dedicated transmission link is coupled to the local area network. A central station is remotely disposed relative to the at least one gaming location, the central station coupled to the local area network by the dedicated transmission link. The central station further includes at least one computer for generating tickets to be sent to the terminals pursuant to requests by players to participate, wherein the tickets are digitally rendered on a display of the terminals and have outcomes predetermined at the central station prior to the request for purchase and also includes means for updating player accounts responsive to requests for participation and winning results as determined at the central station.

In still other illustrative embodiments of the remotely accessed lottery system, the terminals may include a printer device for providing a printout of tickets displayed on the display. The dedicated link may include a wide area network. The terminals are preferably arranged in a kiosk at the gaming location. The tickets preferably include obscured regions having a result invisible to the player wherein the player indicates obscured regions to be revealed thereby revealing a winning or a losing ticket. The terminal may include a mouse input device for controlling a location of an on-screen cursor, the mouse input device for indicating by the player which obscured regions to reveal. The display may be a touch screen display and the obscured regions may be revealed by the player touching the obscured regions to be revealed. The central station may further include means for accessing a state sponsored lottery computer for providing state sponsored lottery games to players.

A remotely accessed lottery system for playing virtual scratch off games includes at least one gaming location including a plurality of terminals, each terminal including a display and an input device, the terminals preferably being connected on a local area network. The input device includes a card reader for reading an identification card having memory storage thereon. The card has identification information, account balance information and statistical information stored thereon. A dedicated transmission link is coupled to the local area network. A central station is remotely disposed relative to the at least one gaming location. The central station is coupled to the local area network by the dedicated transmission link. The central station further includes at least one computer for generating tickets to be sent to the terminals pursuant to requests by players to participate, wherein the tickets are digitally rendered on a display of the terminals and have outcomes predetermined at the central station prior to the request for purchase. Also included is a means for updating player accounts responsive to requests for participation and winning results as determined at the central station, updates determined at the central station being transmitted and stored on the card.

in still other illustrative embodiments of the remotely accessed lottery system, the terminals may include a printer device for providing a printout of tickets displayed on the display. The dedicated link may include a wide area network. The terminals are preferably arranged in a kiosk at the gaming location. The tickets preferably include obscured regions having a result invisible to the player wherein the player selects obscured regions to be revealed, and upon such selection, the system includes means for revealing a winning or a losing ticket. The terminal may include a mouse input device for controlling a location of an on-screen cursor, the mouse input device for indicating or selecting, by the player, which obscured regions to reveal. The display may be a touch screen display and the obscured regions may be revealed by the player touching the obscured regions to be revealed. The central station may further include means for accessing a state sponsored lottery computer for providing state sponsored lottery games to players. The card preferably includes a magnetic strip for memory storage.

Also provided is a method for playing a scratch off lottery game with virtual tickets which includes the steps of providing terminals, each having a display and an input device, the terminals being linked to a remotely disposed central station by a dedicated link, generating tickets at the central station prior to player requests for tickets such that winning tickets are predetermined at the central station prior to player participation, transmitting tickets to be displayed on the displays, the tickets having obscured regions for obscuring ticket information regarding winning status and revealing obscured regions on the tickets by a player to determine if the player has a winning ticket.

In other useful methods, the step of revealing obscured regions may include providing a mouse input device for controlling a location of an on-screen cursor, the mouse input device for indicating by the player which obscured regions to reveal. The display may be a touch screen display and the method may further include the step of touching the display by the player to indicate the obscured regions to be revealed. The step of accessing the central station by inserting a card into the input device, the card including personal information, account balance information and statistical information about the player may also be included.

According to another embodiment of the present invention, a gaming system for facilitating governmental lottery play over an electronic network is provided, comprising an agent server connected via said electronic network for receiving player and ticket information transmitted from a plurality of player terminals, for transmitting said ticket information to a governmental lottery administrator, and for receiving serial numbers issued by said governmental lottery administrator in association with each lottery ticket, a database in said agent server for storing said player and ticket information and said serial numbers associated with each lottery ticket, and a screening unit in said agent server, having criteria required by the governmental lottery administrator pre-stored therein, for verifying that each player satisfies said criteria prior to transmitting said ticket information to said governmental lottery administrator.

The system preferably further includes a verification unit in said agent server for receiving winning numbers drawn by a governmental entity and for comparing said winning numbers with said ticket information stored in said database to determine if there are any winning lottery tickets of which numbers match said winning numbers. The verification unit preferably verifies serial numbers of said winning lottery tickets with said serial numbers previously stored in said database.

The ticket information of the above system includes subscription play information, said system further including a subscription play unit for monitoring subscription play of the same lottery numbers for a specified number of draws.

The ticket information for the above system includes play information for instant games, said system further including an instant game server for issuing instant games.

The system further including a banking server and a banking database for storing player account information, said banking server for debiting a player's account when said player purchases a lottery ticket and for crediting said player's account with a winning amount upon a win from said lottery ticket, said banking server for communicating and transmitting debits and credits of money with said governmental lottery administrator. The banking server communicates with a credit card provider of said player and debits and credits a credit card account of said player upon purchase of a lottery ticket or a win from a lottery ticket purchased by said player. According to an aspect of the invention, the agent server is configured to transmit to said player terminals lottery game data upon confirmation of purchase of a lottery ticket from said governmental lottery administrator, whereby an image in the form of a lottery ticket including ticket numbers selected by said player and said associated serial numbers is displayed on said player terminal of said player. The electronic network is the Internet.

A method is also provided for conducting governmental lottery play over an electronic network, comprising the steps of receiving player and ticket information entered by lottery players, verifying that said lottery players satisfy criteria required by a governmental entity governing said governmental lottery play, storing said player and ticket information of said verified lottery players and receiving serial numbers issued by governmental entity server, wherein each serial number being associated with each lottery ticket. In addition, the method comprises the steps of receiving winning numbers from said governmental entity server, determining winning tickets by comparing said winning numbers with ticket numbers entered by said verified lottery players, and verifying said winning tickets with said serial numbers.

The method further including the steps of crediting a winning amount of each winning ticket to an account of each corresponding winning player, and debiting accounts of said verified players for purchases of said lottery tickets. The verification criteria include a minimum age and residency within border of said governmental entity.

According to an aspect of the invention, the ticket information includes subscription player information including the subscription lottery number and the number of times to be played. The method further includes the steps of monitoring the number of times to be played and stopping when the number of times to be played reaches zero.

The method also includes the steps of transmitting information of said winning tickets to the governmental entity server, said information including said serial numbers associated with said winning tickets, receiving claim validation numbers associated with said winning tickets from the governmental entity server, wherein said claim validation numbers being issued by and stored in the governmental entity server. In addition, the method includes providing said claim validation numbers to each winning player, claiming a predetermined winning amount by submitting said claim validation numbers, verifying said submitted claim validation numbers with said claim validation numbers stored in the governmental entity server, and rewarding said winning amount to said each winning player.

According to another aspect of the invention, a system for facilitating governmental lottery play over an electronic network is provided. The system comprises an agent server connected via said electronic network for receiving player and ticket information from a plurality of players, for transmitting said ticket information to said governmental lottery administrator, and for receiving serial numbers issued by said governmental lottery administrator in association with each lottery ticket. The system also comprises a database in said agent server for storing said player and ticket information and said serial numbers associated with each lottery ticket, wherein said ticket information includes lottery numbers for subscription play of the lottery numbers for more than one lottery draw. In addition, the system comprises a subscription play unit for monitoring the subscription play and putting in play the subscription lottery numbers for a pre-specified number of draws until expiration of a subscription time period.

The system further includes a screening unit in said agent server, having criteria required by the governmental lottery administrator pre-stored therein, for verifying that each player satisfies said criteria prior to transmitting said ticket information to said governmental lottery administrator.

The system also includes means for notifying the player prior to or at the expiration of the subscription time period that play is to end or has ended. According to an aspect of the invention, the agent server is configured to transmit to said player terminals instant lottery game data upon confirmation of purchase of a lottery ticket from said governmental lottery administrator, whereby a the outcome of a lottery ticket is displayed on said player terminal of said player in the form of an image or animation including ticket numbers selected by said player and said associated serial numbers. The electronic network is the Internet A method is also provided for conducting governmental lottery play over an electronic network, comprising the steps of receiving player and ticket information entered by lottery players, verifying that said lottery players satisfy criteria required by a governmental entity governing said governmental lottery play, storing said player and ticket information of said verified lottery players. The method also includes the step of receiving serial numbers issued by governmental entity server, wherein each serial number being associated with each instant lottery ticket. In addition, the method includes the steps of receiving winning numbers from said governmental entity server, determining winning tickets by comparing said winning pattern or numbers with pattern or numbers entered by said verified lottery players, and verifying said winning tickets with said serial numbers.

The method further including the steps of crediting a winning amount of each winning ticket to an account of each corresponding winning player, and debiting accounts of said verified players for purchases of said lottery tickets. The verification criteria include a minimum age and residency within border of said governmental entity.

BRIEF DESCRIPTION OF DRAWINGS

This disclosure will present in detail the following description of preferred embodiments with reference to the following figures wherein.

DETAILED DESCRIPTION OF PREFERRED EMBODIMENTS

The present disclosure describes gaming systems and more particularly, a personal computer and telephone interactive system with voice response and method. A gaming system includes a plurality of player terminals remotely located from a host computer or a business server. Each terminal may include a telephone or a personal computer which connects to a central office and thereby interfaces to the Internet or a plurality of voice response units. The gaming system provides the players remotely located with real time casino gaming or access to a lottery data base for playing selected numbers. The system includes voice response units for providing audio messages to telephones. The system also provides audio signals generated by the business server or a game server via the Internet during game play to run "way" files at the users PC to provide real time audio. The VRUs are connected to a Local Area Network (LAN) to better handle high volume use of the gaming system.

Figure 1:
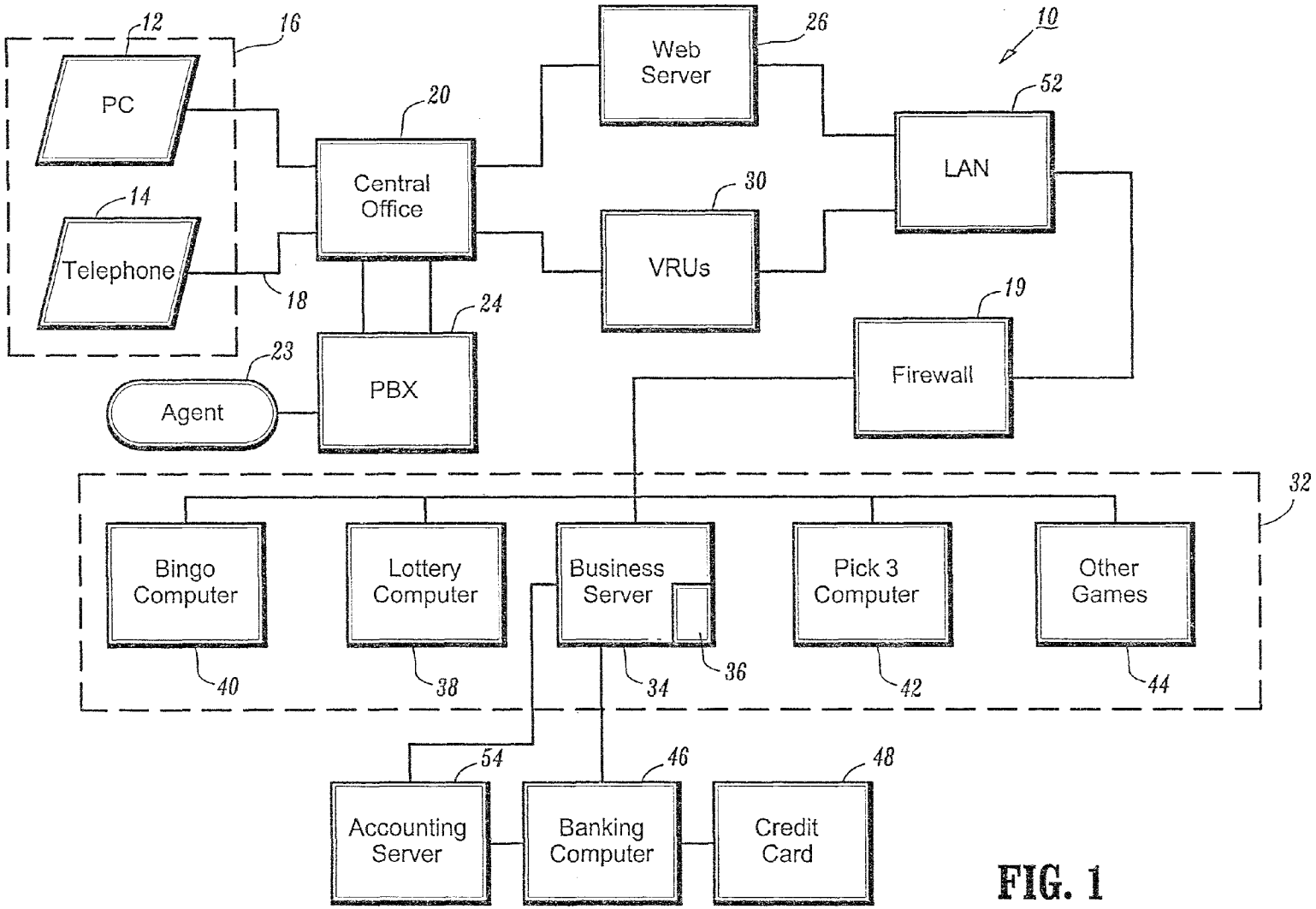
FIG. 1 is a block diagram of a gaming system according to an embodiment of the present invention.

Referring now in specific detail to the drawings in which like reference numerals identify similar or identical elements throughout the several views, and initially to FIG. 1, a block diagram showing a gaming system 10. A personal computer (PC) 12 and/or a telephone 14 are used by a customer, subscriber or user to interface with gaming system 10. PC 12 and telephone 14 are referred to collectively or individually herein as a subscriber terminal or terminal 16. In operation, a plurality of terminals 16 gain access to gaming system 10 simultaneously. Both PC 12 and telephone 14 for each terminal 16 are connected to a central office 20 of a local telephone company where a local loop to which terminals 16 are connected is switched and routed by known methods. Central office 20 connects terminals 16 to either a web server 26 or a plurality of voice response units 30 depending on the media used and the service requested by the user, subscriber or customer.

Figure 2:
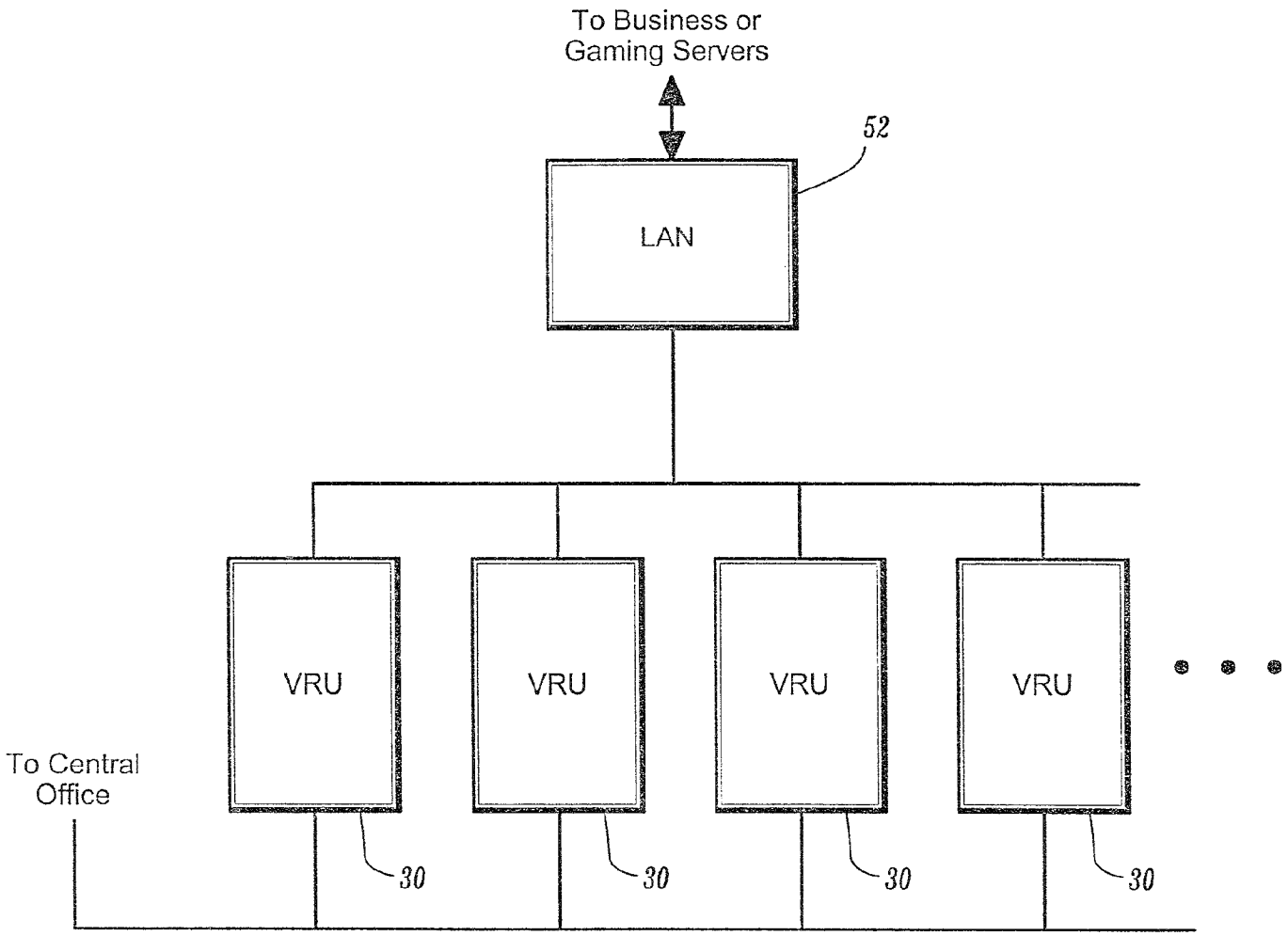
FIG. 2 is a block diagram showing a portion of the gaming system of FIG. 1.

Referring to FIG. 2, it is important to note that VRUs 30 are connected directly to central office 20, and a local area network (LAN) 50 is used to connect the VRUs 30 to a gaming portion 32 of gaming system 10. By connecting LAN 50 behind VRUs 30 instead of connecting a private branch exchange (PBX) 24 in front of VRUs 30, the number of connection ports and therefore the amount of hardware needed for processing assistance requests is greatly reduced. For example, having PBX 24 connect in front of a 5000 port VRU 30 would require PBX 24 to have 10000 ports. Instead, with LAN 50 behind VRUs 30, only 100 ports (lines) are needed. PBX 24 may be separately connected between central office 20 and a live agent 23 to provide a live attendant to a customer who needs assistance. The operation for live assistance requests will be described further below.

LAN 52 provides control signals to VRUs 30 from business server 34 or gaming servers 38, 40, 42 or 44. VRUs 30 receive subscriber entered data from a telephone keypad, for example, in the form of DTMF tones, and send converted signals to business server 34 or gaming servers 38, 40, 42 or 44. VRUs 30 respond to the subscriber entered data from a telephone with audio responses which are sent over the telephone system and heard by telephone speaker. If a PC is used audio signals are sent via the Internet to run "way" files preloaded on PC 12 and converted to sound by a PC sound card and speaker. VRUs 30 include at least one computer box connected together to business server 34 or gaming servers 38, 40, 42 or 44 via LAN 52. VRUs 30 send a command set over LAN 52 to business server 34 or gaming computers 38, 40, 42 or 44 which identify and prompt recordings that each VRU 30 should play in response to the user responses and requests. LAN 52 coordinates VRUs 30 to provide correct audio prompts and responses to the user at terminal 16.

Referring again to FIG. 1, gaming portion 32 is linked to a web server 26 and VRUs 30. A fire wall computer 19 may be used to restrict access to gaming portion 32. A personal identification code will be required to be entered by the customer from terminal 16 to gain access. Gaming portion 32 includes a plurality of game servers. Game servers include a lottery computer 38, a Bingo computer 40, a Pick 3 computer 42, or a computer(s) 44 for other games. Other games may include casino games such as black jack, poker, horse betting, roulette, slot machines etc. Also included in gaming portion 32 is at least one business server 34 for retrieving and processing information stored in a memory storage device 36. Memory storage device 36 stores account balance information for each customer, customer subscription information, customer credit account information, etc.

An accounting server 54 may also be included to calculate debits and credits for customers seeking account information and to provide debits and credits during gaming. Business server 34 or accounting server 54 are linked to a banking server 46. Banking server 46 processes requests for additional credit and debits customers accounts according to charges or subscriptions incurred. Banking server 46 can link by, for example modem, to a lending institution or credit card company to verify account information and to debit customer accounts for charges incurred.

The operation of gaming system is described now in further detail with reference to FIGS. 3-14. The system will be described primarily for use with a telephone, however the call flow is applicable to a PC as well. After dialing into gaming system 10 from terminal 16, a subscriber is introduced to a main menu. The subscriber is welcomed by a prerecorded greeting from VRU 30 (FIGS. 1 and 2) in function block 102. In block 104, the subscriber is prompted to enter an account number, for example, a nine digit number or if the subscriber wants to open a new account, the subscriber is prompted to take an alternate action, for example, press 0. If a new account is selected, function block 106 directs the subscriber to a live attendant, for example a customer service representative. VRU 30 requests a tone via PBX 24 from central office 20 (FIG. 1) and a call is placed to the live attendant (customer service). If an account number is entered in block 104, the account number is checked for validity in block 108. If the account number is not valid, the subscriber is informed in block 110 that the number is not valid and VRU 30 requests that the subscriber try again. The subscriber is returned to block 104 to reenter the account number.

If the account number is valid, the subscriber is granted access to the main menu from block 112 which can be accessed from anywhere in the sequence by entering a code, for example an asterisk (*) from the telephone keypad or typed from a PC. The subscriber may also exit from the main menu by entering another key or keys, for example an asterisk (*) from the telephone keypad or typed from a PC. The subscriber can now choose between beginning to play (1) in block 114, adding money or credits to their account (2) in block 116 or receiving ticket number confirmation (3) for lottery games in block 118. If exit (*) is chosen in block 112, a message from VRU 30 is played thanking the subscriber for their patronage and disconnecting the subscriber from gaming system 10.

Figure 4:
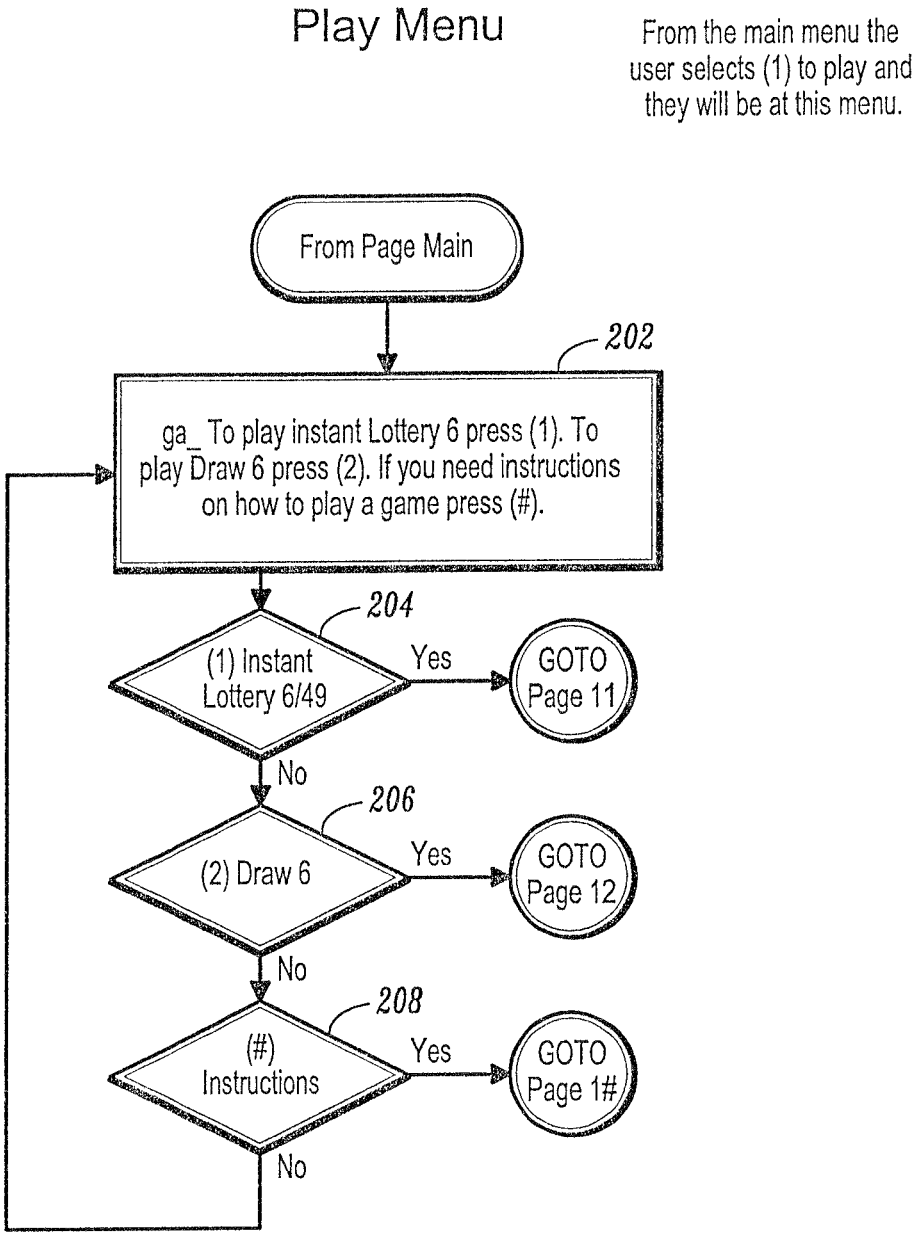
FIG. 4 is a call flow chart showing a play menu.

If the subscriber selects the play option in block 114, a play menu illustrated in FIG. 4 is accessed. The play menu shows by example two options. It is contemplated that other games may be played in the same manner as described herein using the same menu driven sequence. In block 202, the subscriber selects between for example a instant lottery 6 in block 204 or draw 6 game in block 206 by entering or pressing the appropriate key as instructed by a system prompt which may be audio (or visual for a PC). The selection choices may also include an option for game instructions as in block 208. A menu for each individual selection provides access to submenus.

Figure 5:
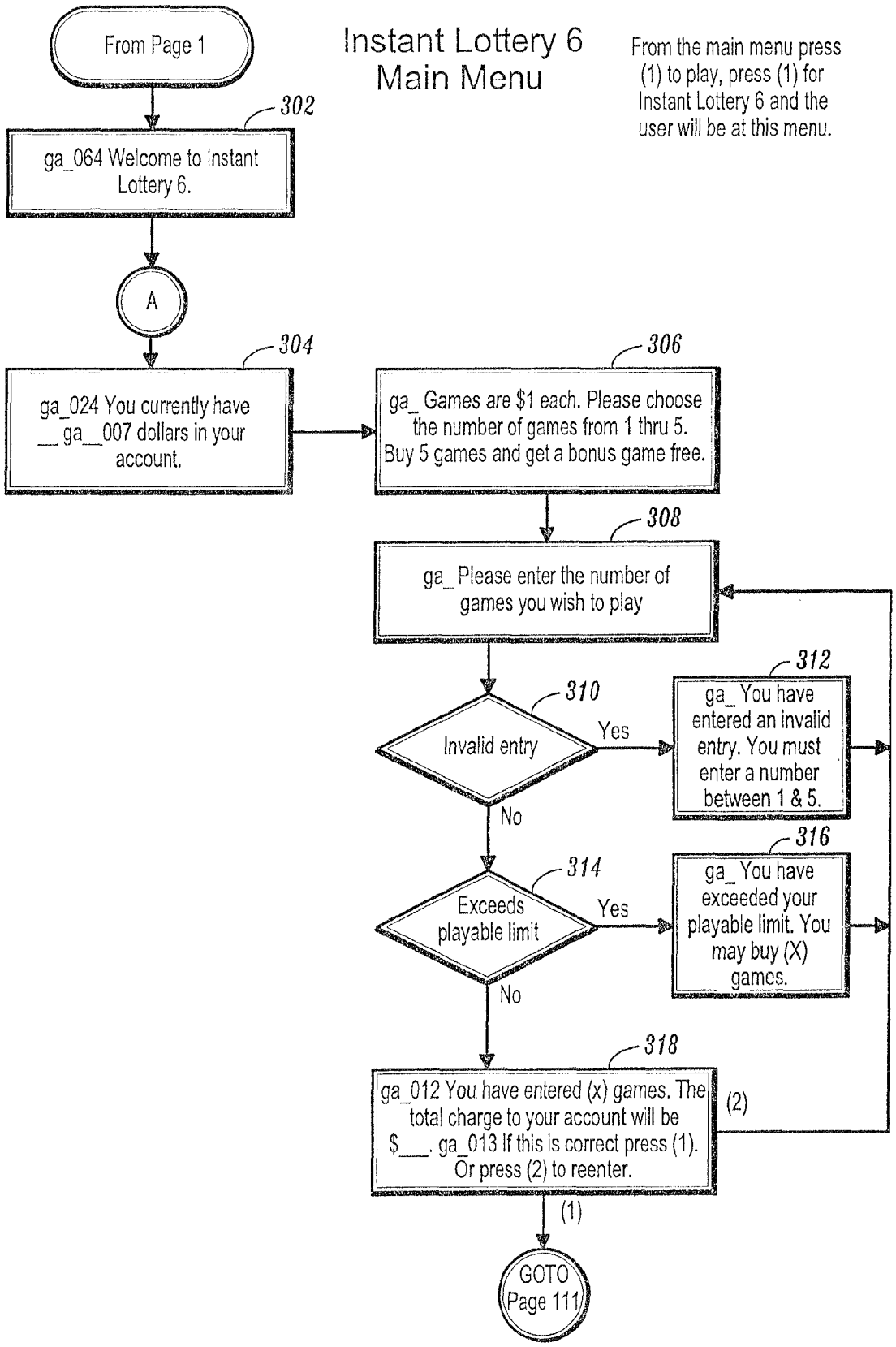
FIG. 5 is a call flow chart showing a main menu for an instant lottery 6 game.

Referring to FIG. 5, if instant lottery 6 is selected in block 204, the subscriber is welcomed to Instant Lottery 6 in block 302. The subscriber may return to the main menu by entering an asterisk (*) for example. Otherwise the subscriber is updated in block 304 on the number of credits or the amount of money available in the subscriber's account. In block 306, subscriber is given a charge rate for playing a game, minimum bets maximum payoffs or other pertinent information related to the current game. The subscriber is prompted by gaming system 10 to enter the number of games the subscriber wishes to play.

Requests for other information may be required in block 308 for example the form in which the winnings may be taken, i.e. cash or credit, payments or lump sum, etc. In block 310 and 314, the requested amount of tickets or the amount of the wager is tested to determine if "house" limits are exceeded or to determine if the subscriber entered data is valid. If the criteria is met, for example in blocks 310 and 314, the subscriber is informed of the problem in blocks 312 and 316, and the subscriber is returned to block 308 to reenter new information in compliance with the restrictions or to correct an error. If the information entered by the uses is valid and within acceptable limits, the subscriber is informed of their bet, given pertinent details related thereto and given an account balance in block 318. The subscriber is also given an opportunity to correct errors if the information is incorrect as given in block 318. The subscriber may choose to return back to block 308 to correct any errors.

Figure 6:
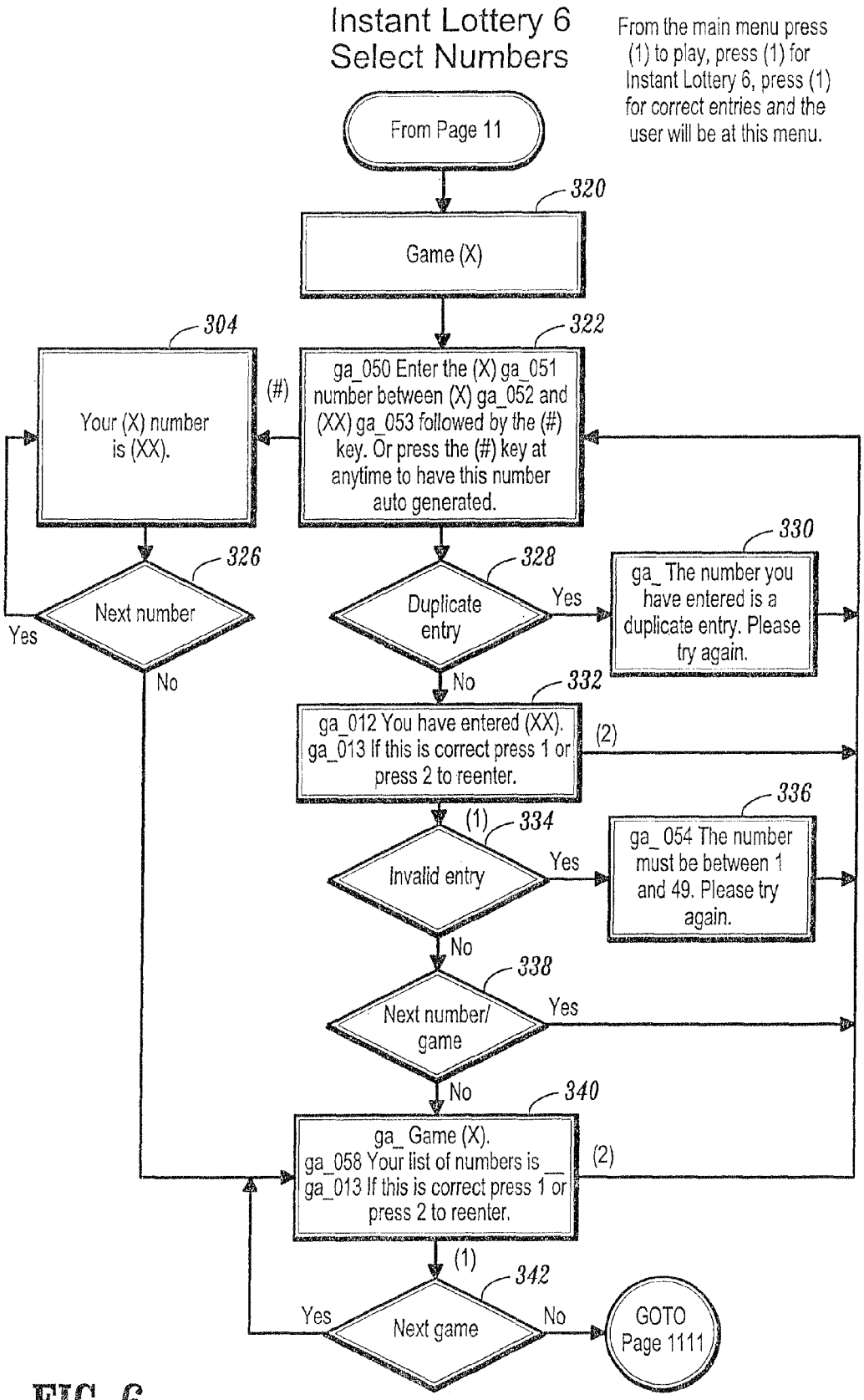
FIG. 6 is a call flow chart showing a number selection process for the instant lottery 6 game.

Referring to FIG. 6, after block 318, the subscriber is informed of the game number prior to selecting the numbers for the lottery game in block 320. Subscriber is informed in block 322 as to any limitations, for example the number range, of the numbers to be selected. Numbers may be selected automatically for the subscriber by entering a pound sign (#), for example. If the pound sign (#) is selected, the subscriber is given each number one at a time in blocks 324 and 326. When all the numbers have been automatically selected, the subscriber is directed to block 340, informed again of the numbers selected and allowed to verify the numbers selected. If the subscriber chooses to pick their own numbers, the gaming system 10 verifies that the numbers selected are not duplicates in block 328. If the number selected is a duplicate of a prior number, the subscriber is informed in block 330 and returned to block 322 to reenter a number. If the number is not a duplicate, the subscriber is asked to verify the number in block 332. The number selected is then tested for validity in block 334, for example the number selected is out of range, as shown in block 336. In block 338, the subscriber is looped back to block 332 and through the number selection process until all the numbers for all the games have been selected. Then the numbers for each game are verified by the subscriber in block 340.

Figure 7:
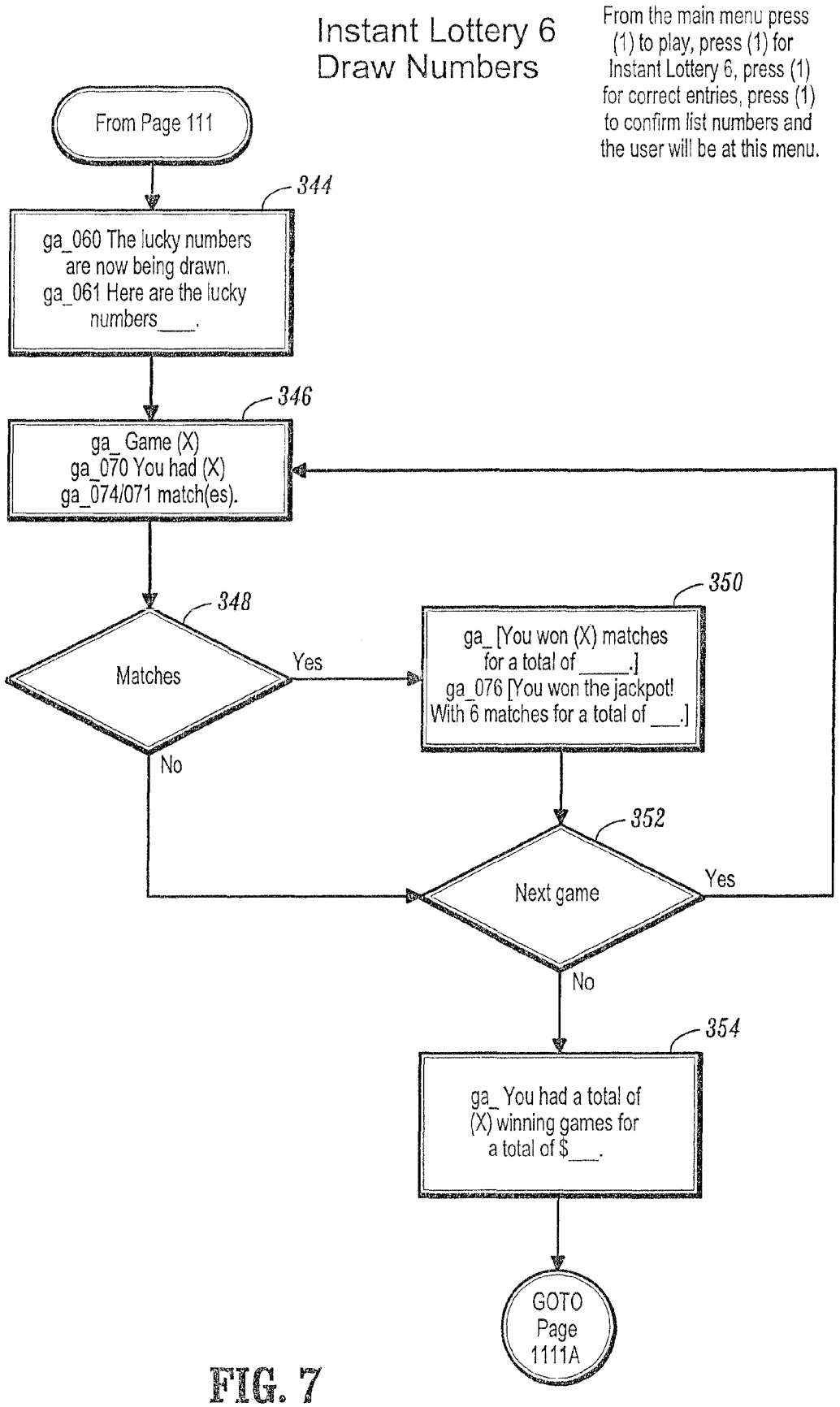
FIG. 7 is a call flow chart showing a number draw process for the instant lottery 6 game.
Figure 8:
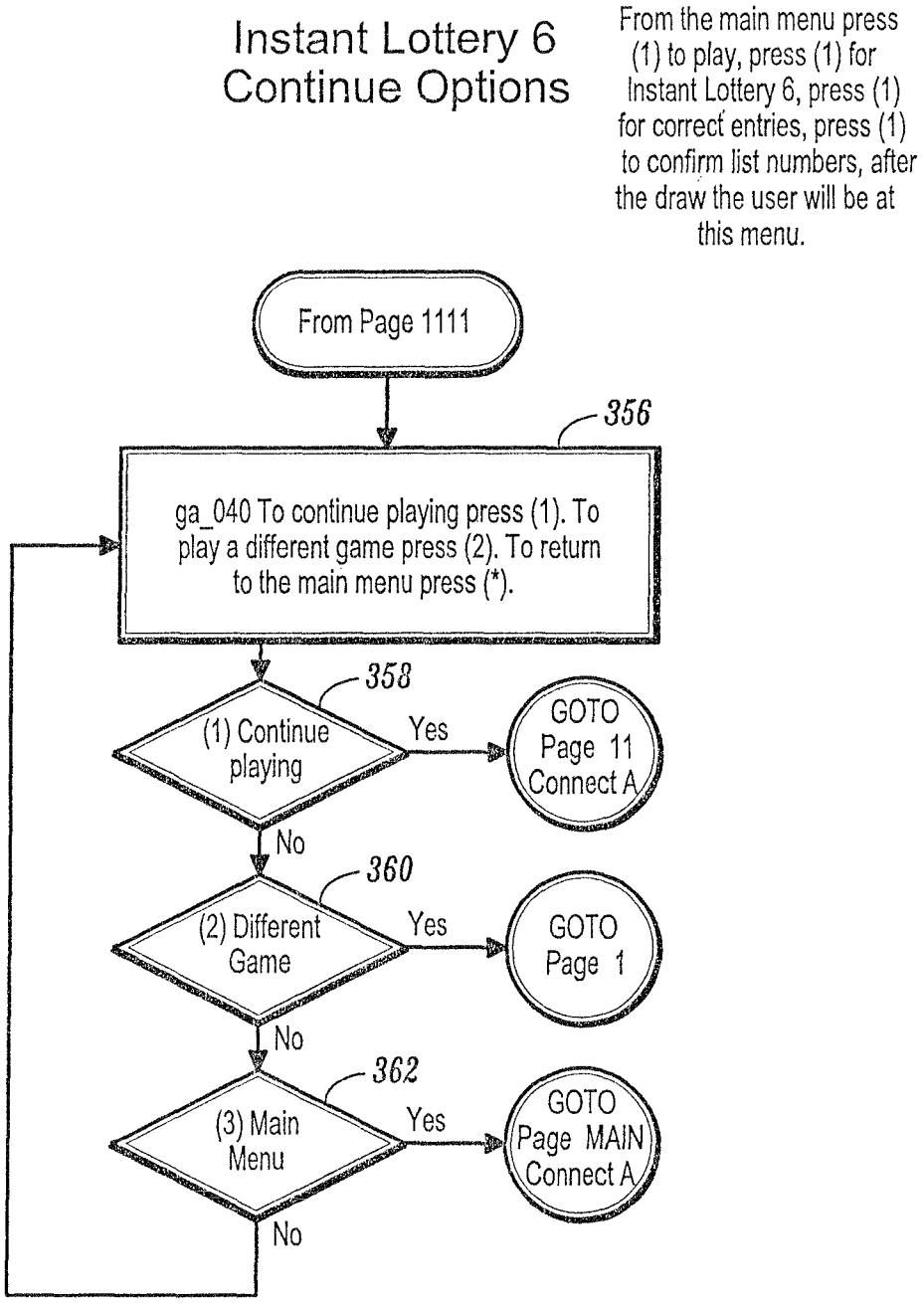
FIG. 8 is a call flow chart showing continue options for the instant lottery 6 game.

Referring now to FIG. 7, the gaming system 10 draws numbers and reports the numbers to the subscriber in block 344. The gaming system 10 compares the results to the numbers selected by the subscriber in block 346. If matches are made between the numbers, block 348 directs the subscriber to block 350 and is informed of the subscriber's winnings. Each game played is looped through this sequence and the total winnings are reported to the subscriber in block 354. Referring to FIG. 8, the subscriber is prompted with continue options in block 356. A selection may now be made to continue to play the present game in block 358, select a different game in block 360 or return to the main menu in block 362.

Figure 9:
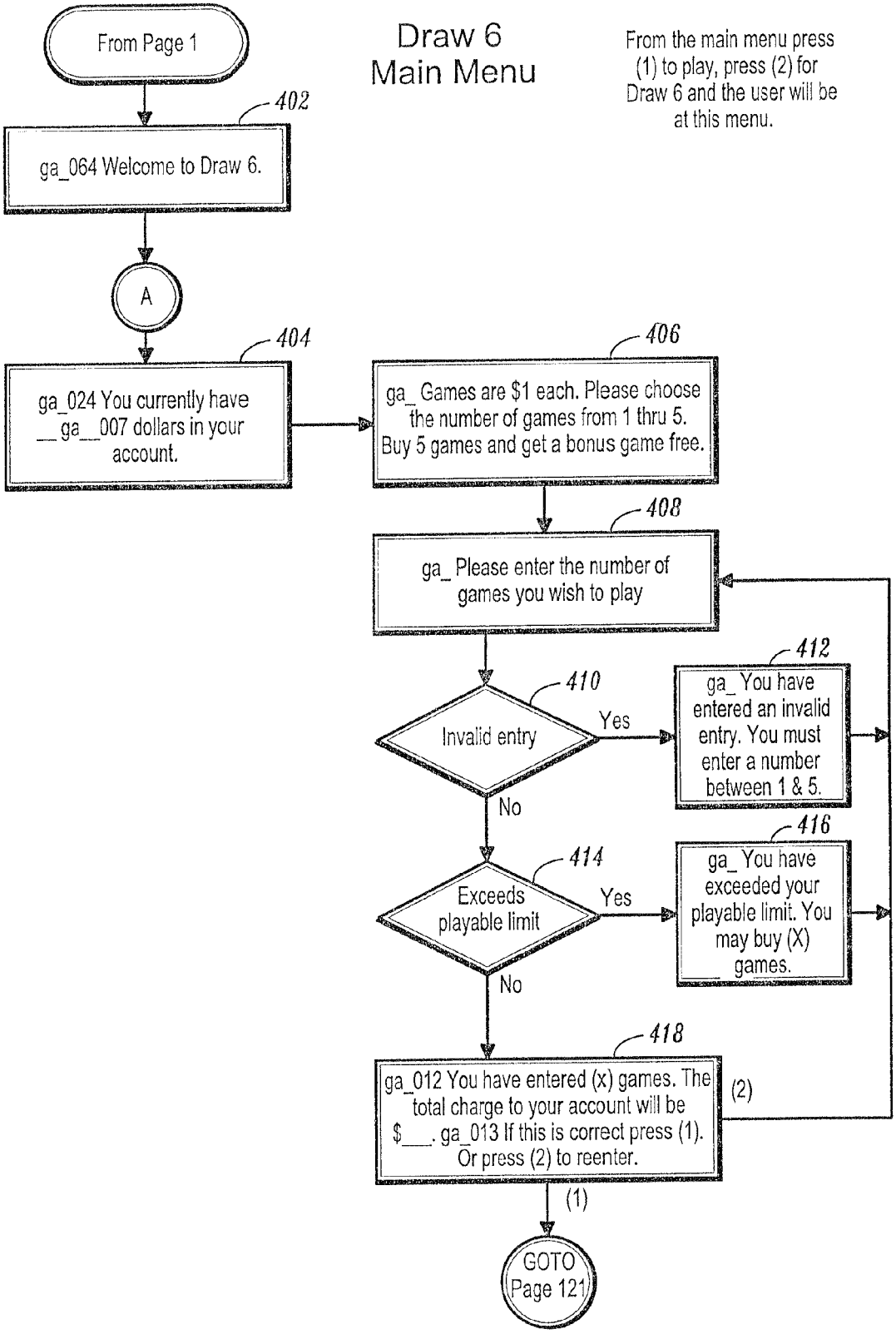
FIG. 9 is a call flow chart showing a main menu for a draw 6 game.
Figure 10:
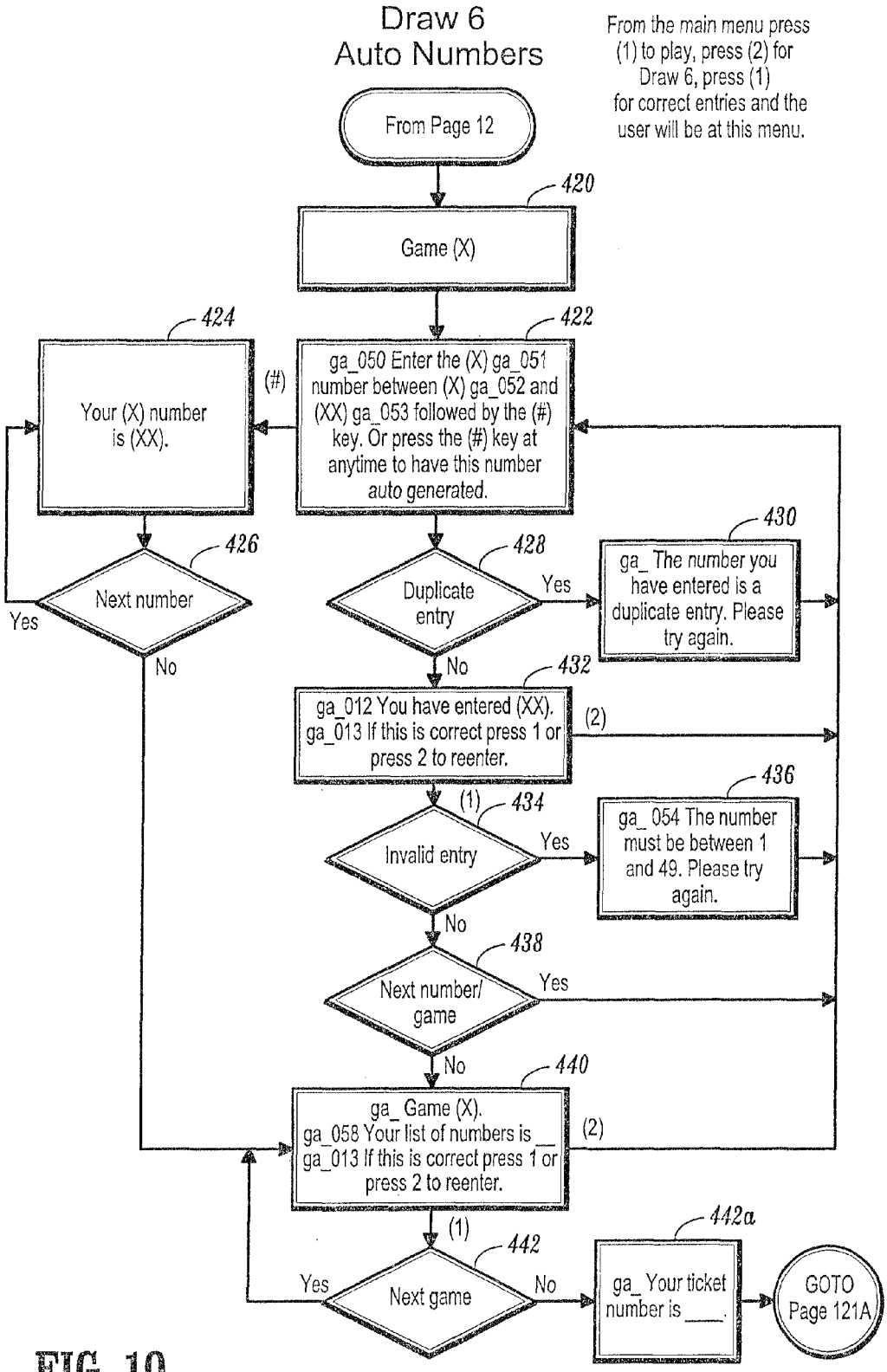
FIG. 10 is a call flow chart showing an auto number selection process for a draw 6 game.
Figure 11:
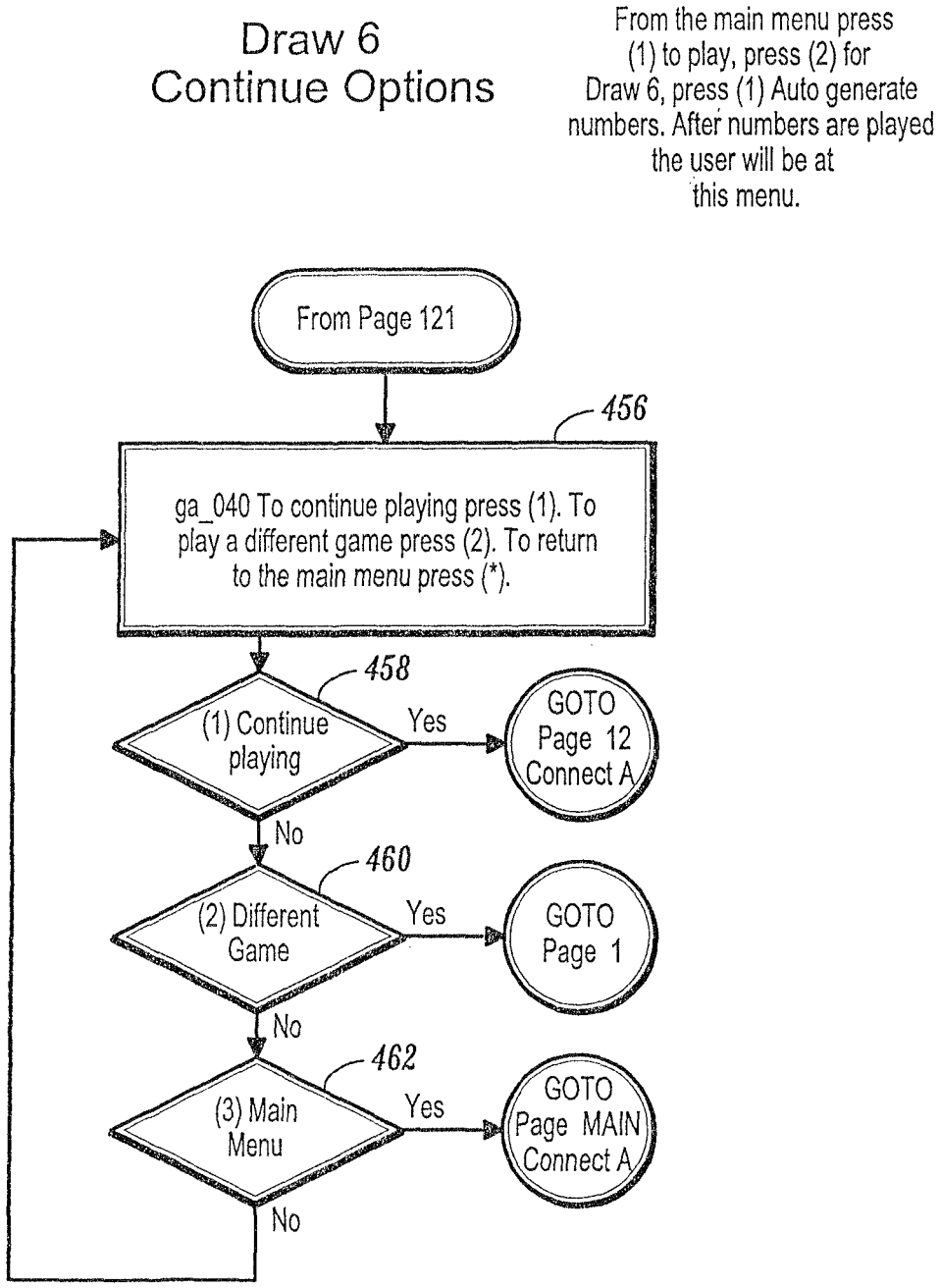
FIG. 11 is a call flow chart showing continue options for the draw 6 game.

If the draw 6 option is chosen in FIG. 4, the subscriber accesses the draw 6 menu. The subscriber may now run through the draw 6 menu which is substantially as described herein above for FIGS. 5-8. The draw 6 menu is illustrated in FIGS. 9-11. The draw 6 game is not an instant game so immediate winnings are not calculated therefore the menu of FIG. 7 is not required for draw 6 and is therefore eliminated and replaced with block 442*a* in FIG. 10. Block 442*a* gives the subscriber ticket numbers for each draw 6 game. The subscriber is notified of any winnings by either a phone call or an email message sent to the subscriber's terminal 16.

Figure 12:
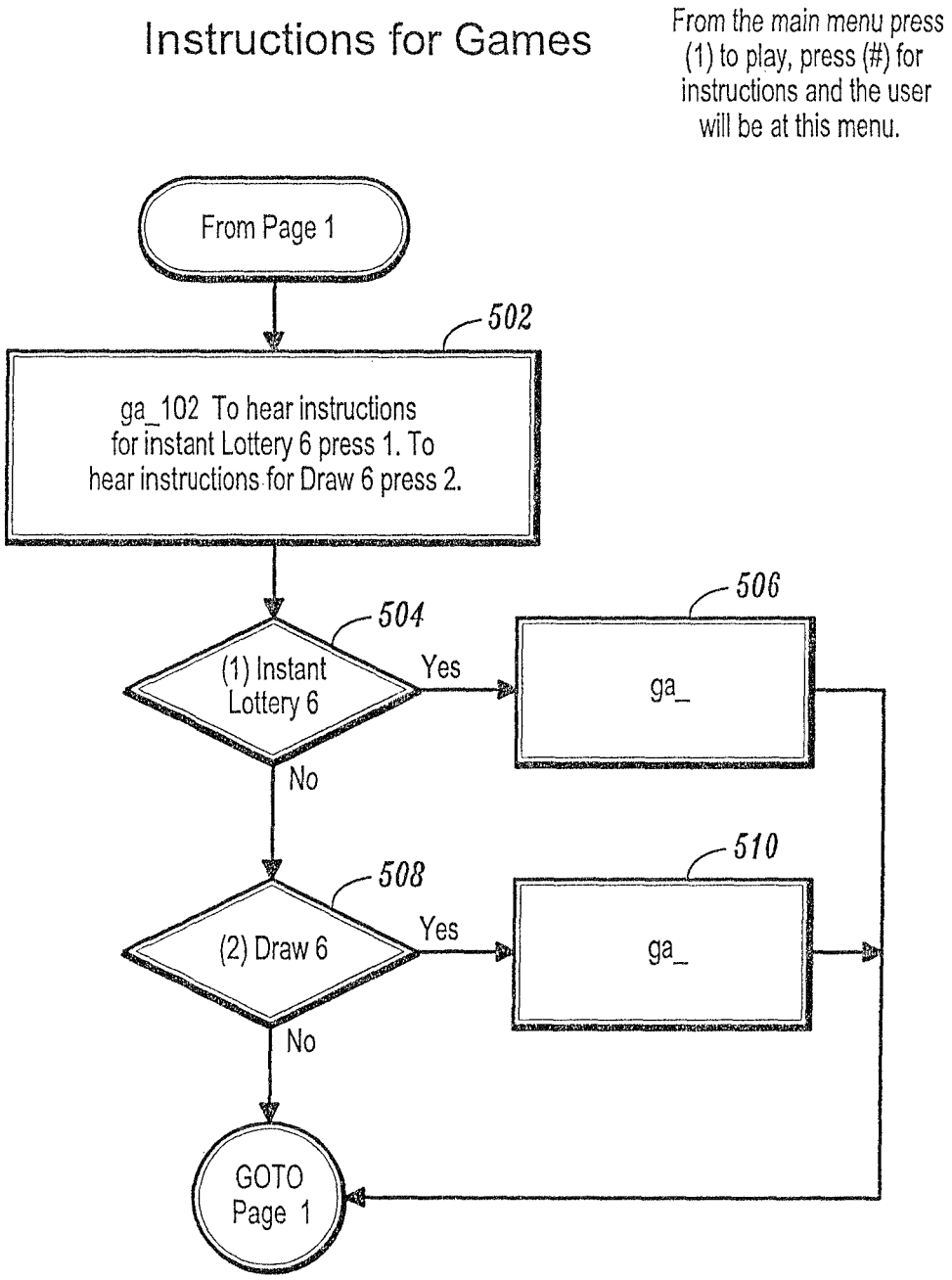
FIG. 12 is a call flow chart showing an instructions for games menu.

Referring back to FIG. 4 and then to FIG. 12, the subscriber selection for game instructions in block 208 transfers the subscriber to a game instruction menu (FIG. 12). The subscriber is prompted to select a game from a list of choices in block 502. After selecting a game the subscriber listens to instructions on how to play that game as in blocks 506 and 510. When finished, the subscriber is returned to the play menu (FIG. 4).

Figure 13:
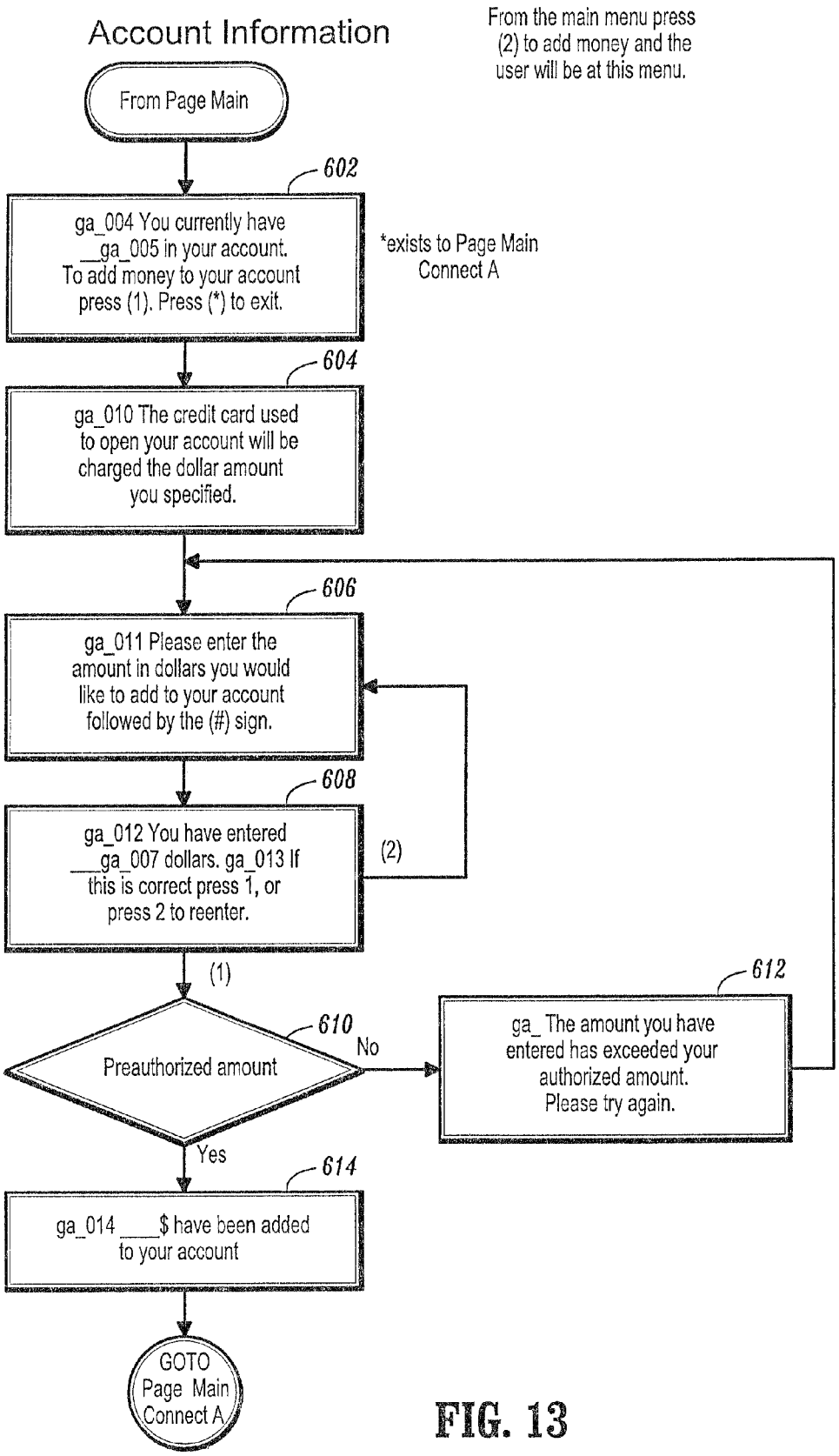
FIG. 13 is a call flow chart showing an account information menu.

Referring back to FIG. 3 and then to FIG. 13, from the selection of block 116 account balances are made available to the subscriber. The gaming system disclosed herein may be incorporated and used with the banking system described in detail in a related application "INTERACTIVE BANKING SYSTEM", (Ser. No. 08/970,377) filed concurrently with the present application. The disclosure of that application (Ser. No. 08/970,377) is incorporated by reference herein. Block 602 updates the subscriber's account balance and prompts the subscriber to make a selection to either add credits or money to the account balance or to exit back to the main menu.

Figure 3:
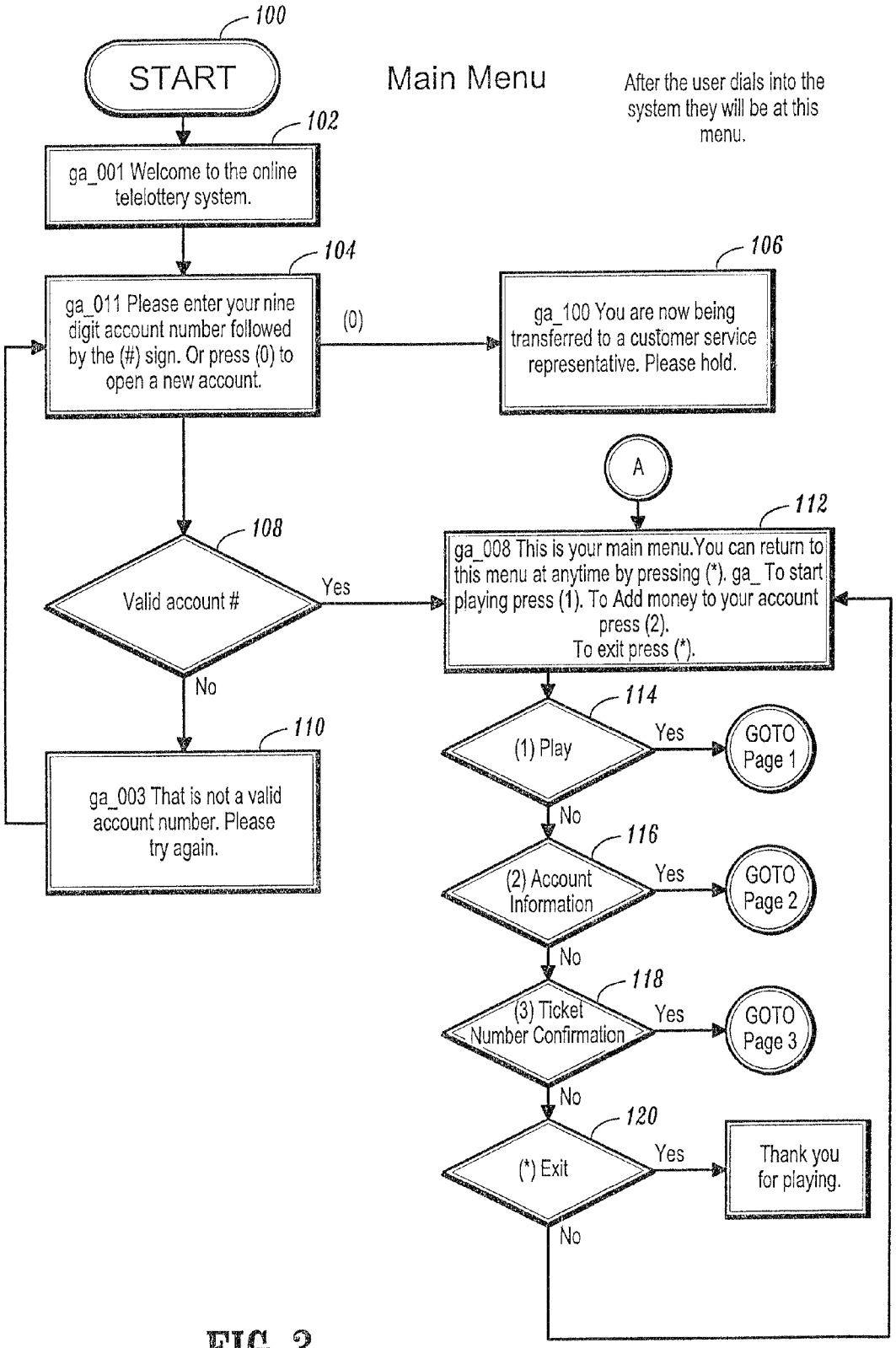
FIG. 3 is a call flow chart showing a main menu.

In block 604, the subscriber is told which credit card or line of credit will be charged to increase the account balance. In blocks 606, an amount is entered by the subscriber (block 606), verified (block 608) and the credit limit checked (block 610). If the credit limit is exceeded, the subscriber is informed of this fact in block 612 and returned back to block 606. If the credit limit is not exceeded the subscriber is updated on the new account balance in block 614 and returned to block 112 of the main menu (FIG. 3).

Figure 14:
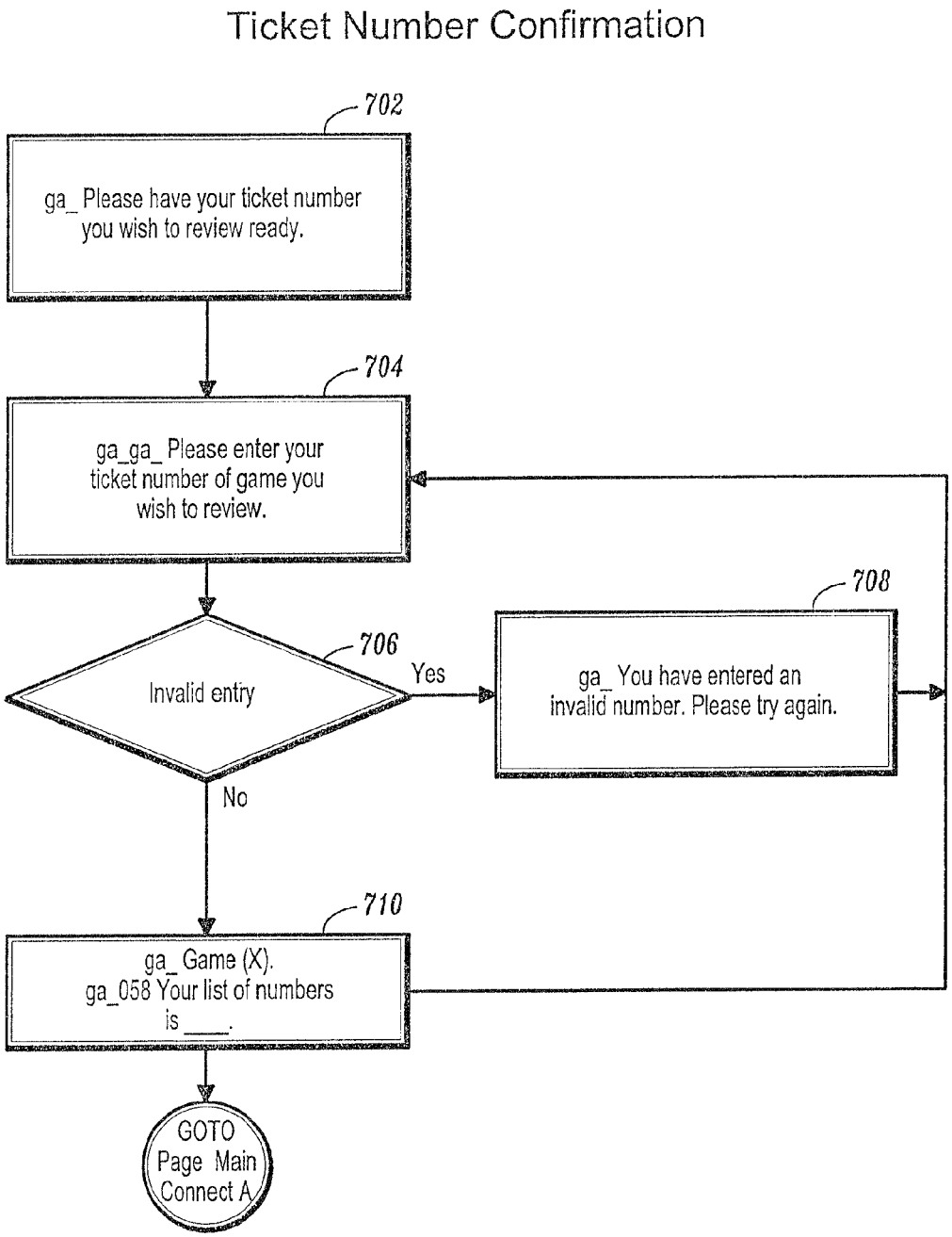
FIG. 14 is a call flow chart showing a ticket confirmation menu.

Referring back to FIG. 3 and then to FIG. 14, from the selection of block 118 ticket numbers may be confirmed by the subscriber. For example, prior to a periodic drawing of a lottery number for draw 6, a subscriber may want to verify the number selection made previously. The subscriber is prompted to have the ticket numbers ready in block 702. The subscriber is then prompted to enter the ticket numbers in block 704. The ticket numbers are verified in block 706, and in block 708 the subscriber is informed of the invalidity of a ticket number. The subscriber is returned to block 704 block 708. If the ticket number entered is valid the list of numbers for that game is announced to the subscriber in block 710. The subscriber may then select to verify other ticket numbers or be returned to block 112 of the main menu (FIG. 3).

Although the previous examples describe two versions of a lottery game, other games of chance are contemplated with slight variations to the above described call flow. For example, a black jack game can prompt a subscriber to enter an amount to bet, ask whether the subscriber wants a "hit", double down etc. An exclusive-number type lottery is also contemplated. A subscriber subscribes to a number or a series of numbers to enter into a lottery, for example. A set of numbers is selected by the subscriber. The set may be made exclusive to the subscriber, i.e., only a single subscriber can have the set of numbers selected and reserved by gaming system 10. These numbers are stored in memory for each subscriber. In this way, a lottery game that selects a reserved number can have only one winner. This is guaranteed by gaming system 10. The exclusive-number type lottery may be played for a predetermined time, e.g. for 6 months, 1 year, 10 years, etc. Preferably, the lottery is a lifetime exclusive lottery. When a subscriber decides to join the lifetime lottery, the subscriber is prompted to enter a set of numbers. After entering the set of numbers the gaming system 10 determines if the entered number set is already taken. If so, the number set is rejected and the subscriber is prompted again to enter a new set of numbers. The gaming system 10 plays those numbers in subscriber selected drawings until the subscription is terminated by the subscriber. The subscriber's credit account is debited each time a lottery drawing in which the subscriber is entered is performed. In the event that the subscriber wins, the subscriber is automatically notified by the gaming system by either telephone of email or both.

The system can provide real-time audio response to the gaming events for example, call out the lottery numbers as they are drawn and announce jackpot winnings. PC 18 requires a sound card and a speaker system in order to reproduce audio crated by preloaded "way" files when signals are sent via the Internet to PC 12 to run the "way" files.

Referring again to FIG. 1, responses and prompts given by gaming system 10 to the subscriber are audio signals from VRUs 30 as well as menus visible on a monitor of PC 12. Various VRUs 30 are selected to respond at various times during the call flow as described above in FIGS. 3-14 above. A subscriber of a PC 12 will be able to hear real-time audio messages created on PC 12 as prompted by signals sent via the Internet over LAN 52 from business server 34 or gaming server 38, 40, 42 or 44.

It is further contemplated that the gaming system 10 is usable through either PC 12 or telephone 14 or a combination of both. Although encryption over the Internet is more readily available, subscribers may feel uncomfortable disclosing credit card numbers or other personal data over the Internet. A telephone can be used instead to access the gaming system to provide sensitive subscriber information. Also, it may be necessary to receive online help from a live attendant. VRU 30 can be activated to alert and call the live attendant. A code, for example 0, can be entered to alert VRUs 30. VRUs 30 send a switch hook flash to central office 20 to request a dial tone. When the dial tone is received VRU 30 is terminated and the call is redirected to central office 20 and is answered by PBX 24. A recording is played for the subscriber. The subscriber can now select an action from a menu which includes the live attendant.

Figure 15:
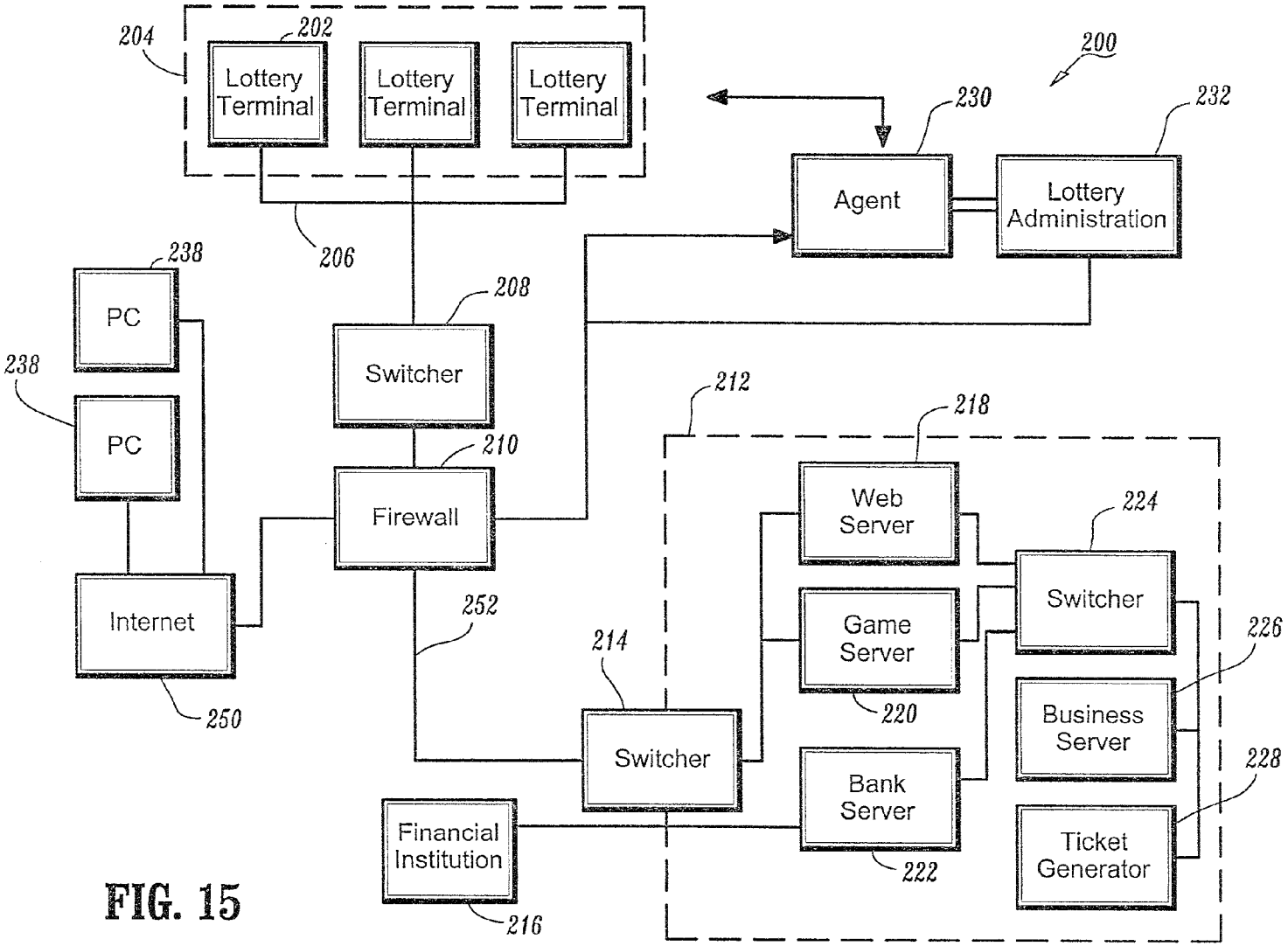
FIG. 15 is a schematic/flow chart showing a remote lottery system according to the present invention.

Referring to FIG. 15, another gaming system 200 is shown. A plurality of lottery terminals 202 or PCs 238 are remotely located from a central station 212. Lottery terminals 202 may be located at a gaming hall or other remote location where lottery-type games may be played. Lottery terminals 202 include an input device and a video display. Lottery terminals preferably include a printer device for printing out tickets to memorialize a player's gaming history or as proof of winnings. Lottery terminals 202 may be arranged in a kiosk 204 for providing player stations to a plurality of players simultaneously. PC 238 also provides access to central station 212 from any remote location. PC 238 includes a modem for connecting to central station 212 and appropriate software which may be downloaded from central station 212 as needed or provided on a memory storage device. PC 238 may be connected via the Internet to a fire wall computer 210 for accessing central station 212 via a dedicated link 252.

Lottery terminals 202 preferably require an identification card 300 (FIG. 21) for enabling play by players. Players are issued cards 300 which have memory storage capability. Stored information includes the players name, identification number or password, account information such as account balances and statistical data including personal performance data, gaming history data as well as other statistics. Also, debit and credit information is stored on card 300 (FIG. 21). Card 300 may have an account balance increased by agent 230 or by using a device which accepts money directly. Lottery terminals 202 may be used to increase a credit amount on a card and automatically debit the card in response to debits incurred during game play. PC users can log in to central station 212 over Internet 250 or through a telephone connection as described with reference to FIG. 1 above.

Terminals 202 are preferably connected by a local area network (LAN) 206. LAN 206 connects to a switch 208, for example, a 100 Base T switcher which provides switching as is known in the art. A firewall computer 210 limits access to central server 212 and may be used to access a state lottery computer 232 or other remote gaming system. Firewall computer 210 provides administrative information to an agent 230 for maintaining security of the system. Agent 230 may also assist in the administration of kiosk 204 and act as an interface to state lottery computer 232.

Another switcher 214 interfaces with central server 212. One aspect of the present invention is that the central station 212 is remotely located. A dedicated interconnect 252 connects a plurality of kiosks 204 with central station 212. Dedicated interconnect 252 may include a wide area network (WAN). A web server 218 is provided for controlling Internet games and interfaces for PC users and for accessing a game server 220. Game server 220 is accessed directly through switcher 214 for kiosk based games. Web server 218 and game server 220 connect to a switcher 224 which interfaces to a business server 226 which functions substantially as described above with reference to FIG. 1. Switcher 224 also routes commands to a bank server 222 for debiting and crediting accounts as described above. Further, bank server 222 can access a financial institution or credit card company computer 216 as described above.

A ticket generator 228 is provided and connects to business server 226 for providing virtual tickets to players. Ticket generator 228 generates and stores tickets according to a predetermined schedule of winning tickets. Various systems of winning ticket determination schedules may be used, for example winners may be determined based on the order in which they accessed the system. Preferably, the games offered on each of the kiosks involve games having winners predetermined upon selection by a player and no skill is needed from the player to improve on his/her chances of winning. A further advantage of each system architecture includes multiplayer play of a single or multiple games. Such game or games are processed, monitored and/or outcome predetermined from and by the server or processor in the central station.

Figure 16:
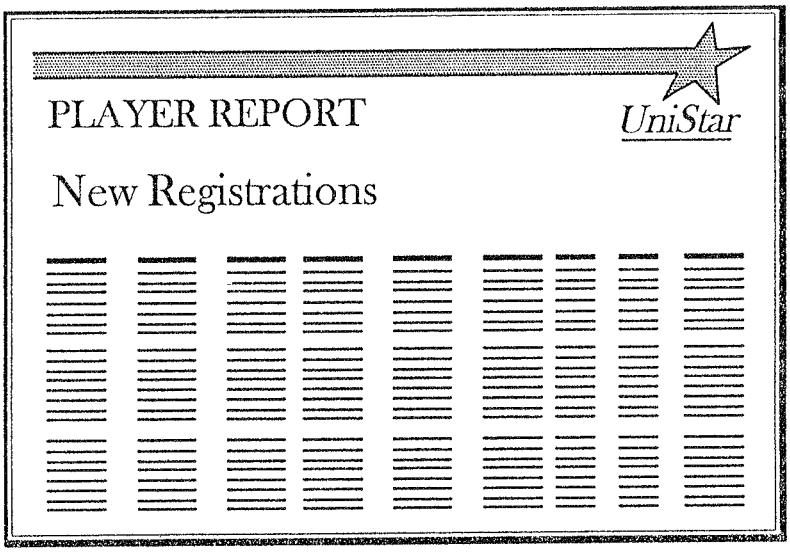
FIG. 16 is an illustration of a player/game report provided by the present invention.

In a preferred embodiment, ticket generator 228 generates a plurality of tickets in an arbitrary order. As each request to purchase a ticket is received from terminals 202 or 238 a digital image is sent and reproduced at the player's terminal. The ticket has a predetermined result thereon which is obscured from player view. The player than uses a cursor to indicate regions to be revealed or uses the cursor, a finger or other object to unobscure the predetermined result. Each terminal 202 accesses a printer for printing out tickets if desired. Further, as shown in FIG. 16, a player report 400 can be generated to a screen or printed out by the printer. The player report may include, among other things, player statistics, game reports including player account balances and play by play game information. Advantageously, the system according to the illustrative embodiment of the present invention facilitates lottery-type game play with which the software including gaming programs and algorithms, accounting and bookkeeping programs, etc. can be totally resident at the control station. Accordingly, game software need not be resident at the lottery terminals.

Figure 17:
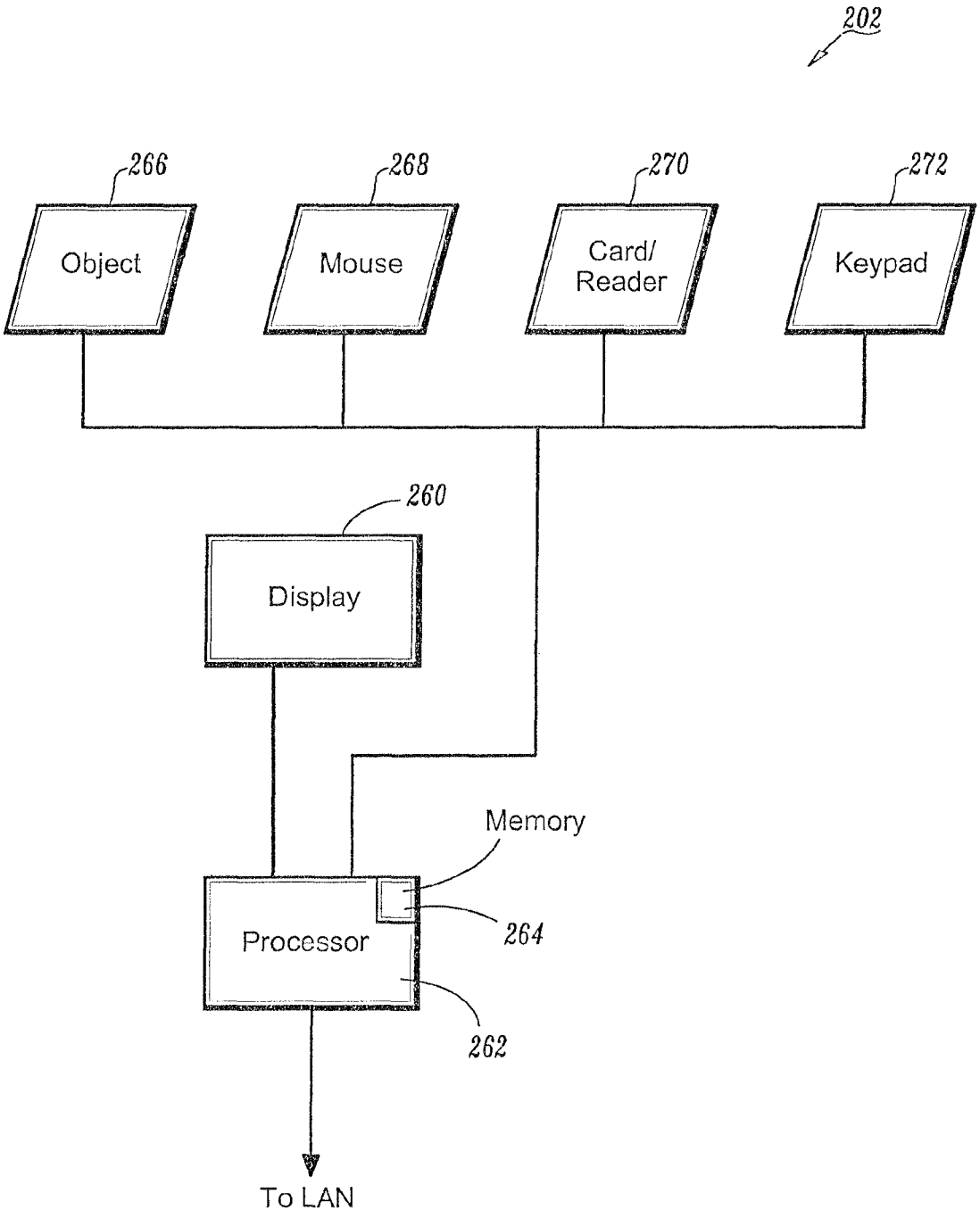
FIG. 17 is a schematic diagram of a terminal in accordance with the present invention.

Referring to FIG. 17, a schematic diagram is shown for terminal 202. Terminal 202 includes a processor 262 for generating graphics on a display 260. Processor 262 includes software in memory 264 for processing input commands from input devices. Input devices may include any one or a combination of an object 266, a mouse 268, a card/reader 270 and/or a keypad 272. Object 266 may include a players finger or other device for indicating obscured regions 242 (FIG. 18) to be revealed if a touch screen display is employed for display 260. Mouse 268 may be used to control an on-screen cursor for selecting various options presented to the player, for example indicating obscured regions 242 to be revealed or to initiate a print command, etc. Card/reader input 270 includes an insertion slot for a user or player card (card 300, see FIGS. 21A and 21B). Data stored on the card is input and transmitted to central station 212 for processing. Keypad 272 is used to enter alphanumeric data and/or execute commands, etc. as is known in the art.

Figure 19:
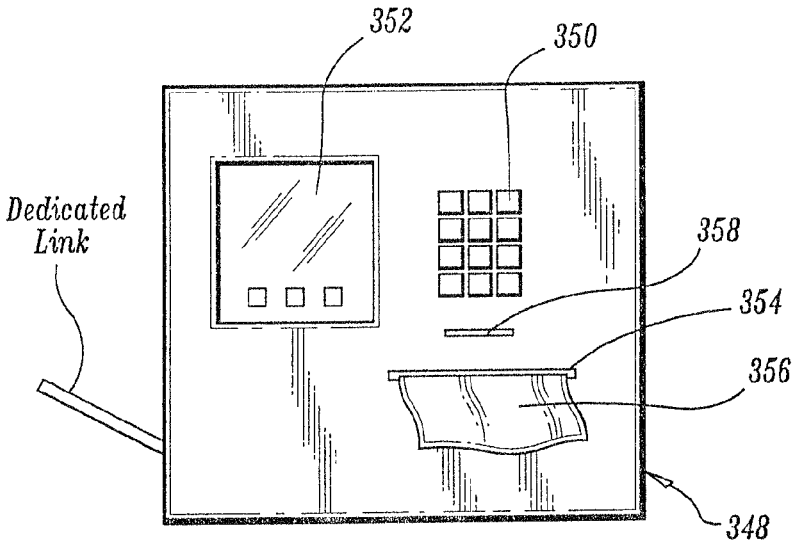
FIG. 19 is a schematic diagram of a remote terminal, such as an automatic teller machine or a vending machine, for use with the present invention.
Figure 20:
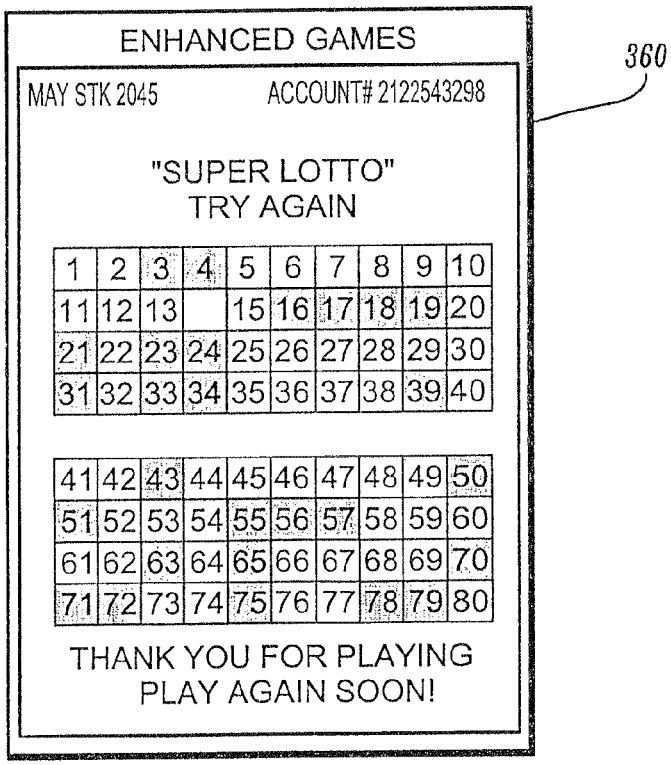
FIG. 20 is an illustrative ticket/printout form the terminals of the present invention.

As shown FIG. 19, lottery terminals 202 may include a conveniently located terminal 348 such as a vending machine or an automated teller machine (ATM) for implementing lottery-type games in accordance with the present invention. Interaction with central station 212 occurs through a dedicated link. Input keypad 350 or touch screen display 352 located at terminals 348 are used to interact with the system of the present invention. Terminal 348 preferably include a printer 354 for printing game reports/player reports 356 as described above, and a card reader/writer 358 is provided. Terminals 348 can advantageously provide the features for playing lottery type games remotely from the central station as described above. Further, as shown in FIG. 20, a lottery ticket/record 360 may be printed out as proof of winning or to provide a record of the transaction.

Figure 18:
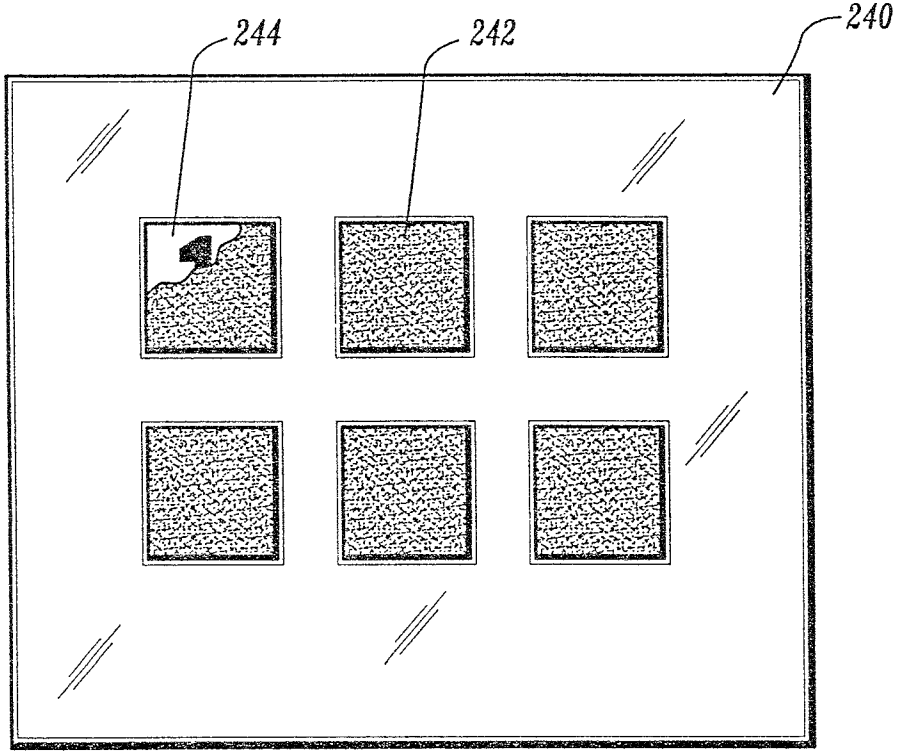
FIG. 18 is a illustrative schematic of a display of a virtual scratch off ticket in accordance with the present invention.

Referring to FIG. 18, the present invention provides virtual scratch off games which are played on a video display 240 of terminals 202, 238 or 348. An illustrative game is shown to explain aspects of the present invention. Obscured regions 242 are provided to terminal 202 by central station 212. Obscured regions 242 obscure a symbol or result of a lottery game. Obscured regions 242 may be selected by the player to reveal a result for that ticket. In one embodiment, the result is dependent on which obscured regions are selected, for example a symbol or prize is won if a pair or more of symbols are unobscured prior to unobscuring a predetermined number of regions 242. For example, if three symbols are the same and six unobscured regions are presented, a winner may be determined based on unobscuring the three symbols in say, 4 attempts (one attempt equaling unobscuring one region). State sponsored scratch-off games may be implemented in a virtual scratch-off game in accordance with the present invention. Predetermined odds and a number of winners are determined prior to play at central station 212. The display of terminals 202 may be a touch screen display which permits virtual scratching off of obscured regions 242.

Players may participate in a lottery game, either a state sponsored game as accessed through a lottery computer 232 (FIG. 15) or a non-state sponsored lottery game. Players select numbers at terminals. The numbers are transmitted to game server 220 for storage. In a non-state sponsored lottery drawing, an instant drawing may be held and the results transmitted directly to terminals. Drawings may be provided by central station 212 for individual terminals, for a given kiosk, to a specific locale or to all players.

Figure 21A:
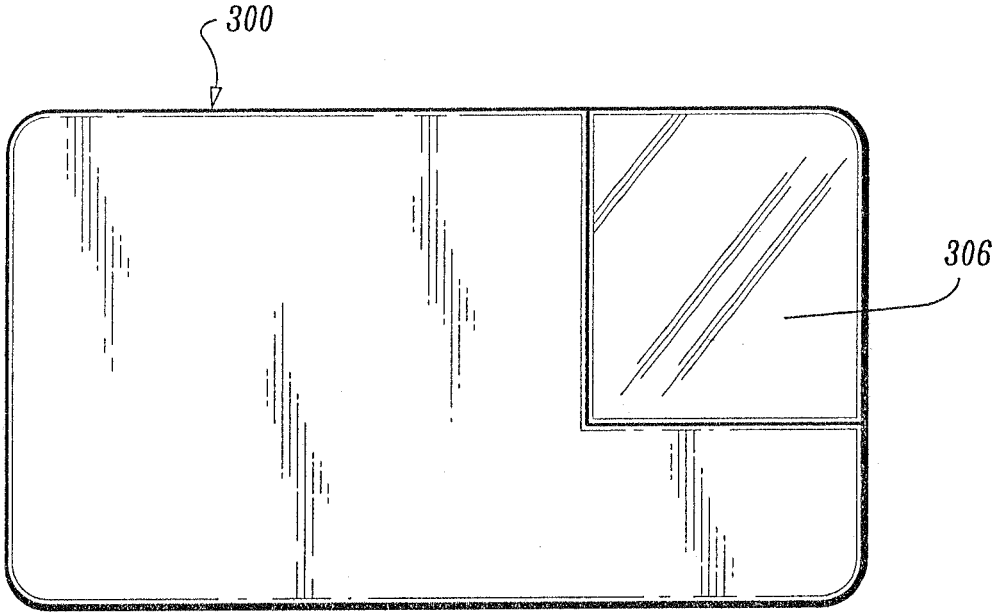
FIGS. 21A and 21B are a front and back view of an identification card for use with the present invention.
Figure 21B:
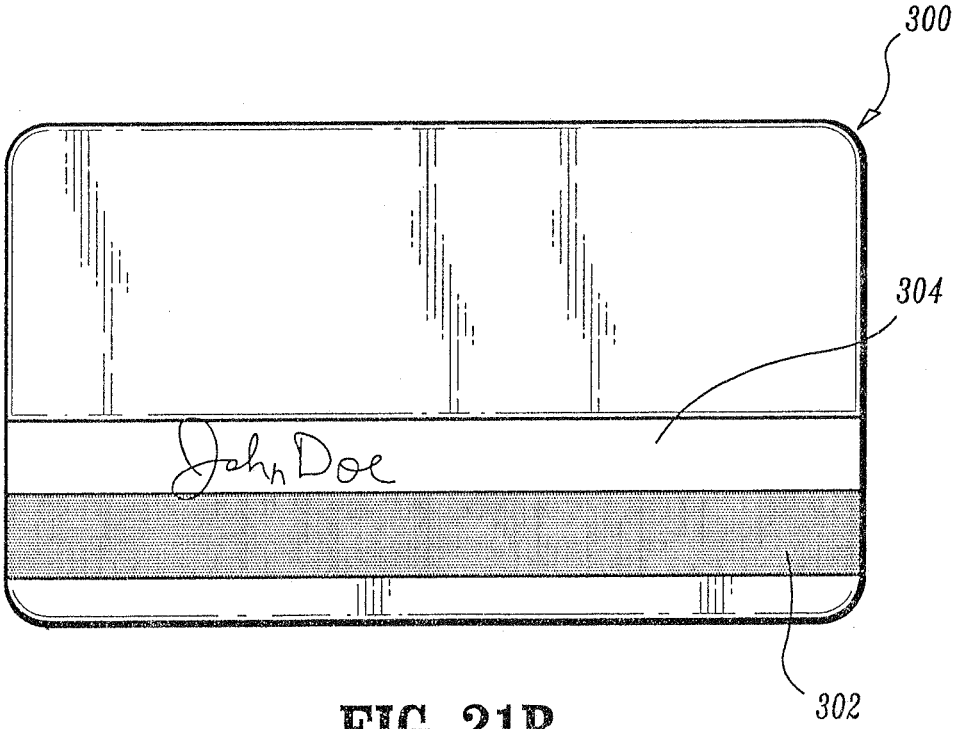

Referring to FIGS. 21A and 21B, a front (FIG. 21A) and back (FIG. 21B) of an identification card 300 is shown. Identification card includes at least one magnetic strip 302 for storing player identification information, player statistics, account information and balances or other pertinent information. Magnetic strip 302 is read at terminal 202 by a magnetic strip reader, for example a three track magnetic strip reader. Card 300 also provides a signature region 304 and a display region 306 which may include written identification information or graphic information, such as a photograph. Terminals 202 provide access to central station by inserting card 300 therein. Other access methods may also be provided, such as password access during log on.

Figure 22:
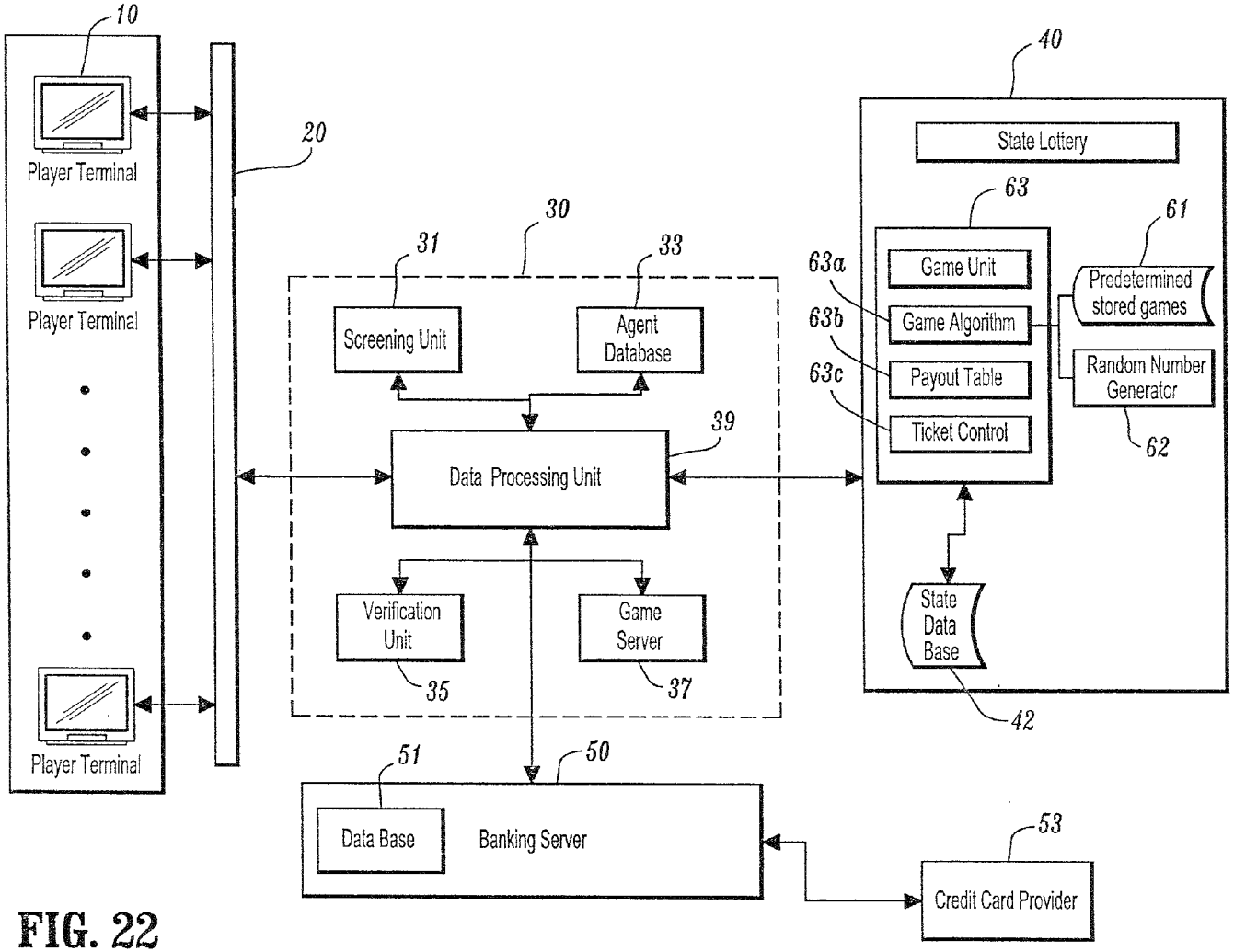
FIG. 22 is a block diagram of a gaming system according to an embodiment of the present invention.

FIG. 22 is a block diagram of a gaming system according to a preferred embodiment of the present invention. Referring to FIG. 22, player terminals 10 are used by lottery players to enter information for playing lottery games. The player terminals 10 may be personal computers of the lottery players and/or lottery terminals specific for playing lottery games and located at readily accessible places. To purchase lottery tickets, the lottery players enter at the player terminals 10 player information, such as age and address, account number of the player and ticket information, such as types and numbers of lottery tickets to be purchased, including specifying subscription play as a subscriber. A player's information and ticket information are transferred via a communication network 20 to an agent server 30. The communication network 20 is preferably a global electronic network such as the Internet through which a lottery website is provided for the lottery players to log on.

The agent server 30 includes a plurality of program modules having stored codes executable by a data process unit 39 for effecting agent server functions including communicating over the electronic network. Other modules include a screening unit 31 for verifying based on the player information that each lottery player satisfies certain criteria required for playing lottery games, an agent database 33 for storing the player and ticket information and serial numbers generated by a state lottery administrator 40, a verification unit 35 for verifying winning tickets based on the ticket information and the serial numbers after a drawing of winning numbers, a game server 37 for storing and providing various types of lottery games including but not limited to draw games, subscription play and instant games. The data process unit 39 also communicates control and data signals with the above and other components of the agent server 30. Detail description of the agent server 30 in FIG. 22 follows.

When a lottery player enters his/her player and ticket information at a player terminal 10 to purchase lottery tickets, the screening unit 31 receives the player and ticket information and verifies based on the player information that the lottery player satisfies certain criteria required by the state. The criteria, for example, minimum age and residency within the border of the state, are set by the state as a condition to purchase lottery tickets. Such criteria may be previously stored in the screen unit 31. For the verification, the screening unit 31 compares the criteria with the player information to confirm that each and every requirement of the criteria is satisfied with each corresponding data of the player information. For example, the screen unit 31 performs comparison and determination with respect to whether the lottery player's age is over the minimum age, whether the lottery player's address falls within the border of the state, and so on. If the player information is successfully verified by the screening unit 31, the verified player information along with the ticket information is stored in the agent database 33 under the control of the data process unit 39. Upon such verification, the ticket information is transmitted to the state lottery administrator 40 under the control of the data process unit 39. Upon receiving and storing the ticket information in a state database 42, the state lottery administrator 40 issues serial numbers associated with the lottery tickets to be purchased in accordance with the ticket information. Each of the serial numbers is associated with each of the lottery tickets to be purchased. That is, each serial number is unique to each lottery ticket to be purchased. The serial numbers are then transmitted to and stored in the agent database 33 under the control of the data process unit 39.

Upon receiving the serial numbers associated with the lottery tickets from the state lottery administrator 40, the data process unit 39 confirms the purchases of the lottery tickets and generates control signals to the game server 37 for playing lottery games. In response to the control signals from the data process unit 39, the game server 37 provides the player terminal 10 with image data in the form of the lottery tickets purchased. The player terminal 10 displays on its screen virtual lottery tickets corresponding to the image data of the lottery tickets purchased. The image data may include ticket numbers selected by the lottery player and the serial numbers associated with the lottery tickets. The game server 37 may previously store image data of various types of lottery tickets. The lottery player can then play lottery games with the virtual lottery tickets displayed on the player terminal 10. That is, the lottery player observes a drawing of winning numbers and matches between the winning numbers and the ticket numbers of the virtual lottery tickets. The lottery player can also interactively communicate with the agent server 30 via the Internet 20 while playing lottery games.

The players can also select subscription play from the types of games made available to players from agent server 30. A player selects from the website operated by the agent server 30 the subscription play icon. A subscription form appears to prompt the player to enter subscription play information such as the number of plays, the actual numbers to be played, and the amount of wager per play, etc. The subscription information received by agent server 30 is stored in database 33. A subscription play unit (not shown) in game server 37 monitors the subscription play data stored in database 33. For example, if the number of plays entered by the subscriber player is weekly play, the subscription play unit, in connection with data process unit 39 and agent database 33, will put in play the actual numbers selected by the player (stored in database 33) each week. The subscription play unit also monitors the specific number of plays by counting down by one each time the lottery numbers are played until the specified number of play becomes zero. The subscription play unit preferably generates a 'subscription play complete' flag and the player is notified of the completion of subscription play by agent server 30. Preferably, the flag is generated prior to or at the expiration of the number of plays or the specified time period and the subscriber player is notified prior to or at the end of subscription play. The notification can be sent by email or sent to the account of the player which the player can access over the global electronic network.

After winning numbers are drawn from each game, the state lottery administrator 40 provides the winning numbers to the agent sever 30 or the winning numbers are entered into the agent server 30 after they are publicly announced. The verification unit 35 receives the winning numbers and determines if there are any winning lottery tickets of which ticket numbers match the winning numbers. For the determination, the verification unit 35 accesses the ticket information stored in the agent database 33 which includes the ticket numbers of the lottery tickets purchased. The verification unit 35 then compares the respective ticket numbers with the winning numbers to determine the winning lottery tickets.

Upon determining the winning lottery tickets, the verification unit 35 verifies the winning lottery tickets with the serial numbers previously issued by the state lottery administrator 40. For the verification, the verification unit 35 accesses the serial numbers stored in the agent database 33. Since each of the serial numbers is previously issued in association with each of the purchased lottery tickets and stored in the agent database 33, each of the winning lottery tickets can be verified by confirming the serial numbers of the winning lottery tickets with the corresponding serial numbers retrieved from the agent database 33.

Upon being successfully verified with the corresponding serial numbers, information of the winning lottery tickets including the serial numbers are transmitted from the agent database 33 to the state lottery administrator 40 under control of the data process unit 39. Upon receiving the information and the serial number of the winning tickets, the state lottery administrator 40 issues claim validation numbers associated with the winning tickets. Each of the claim validation numbers is unique to each of the winning tickets. The issued claim validation numbers are stored in the state database 42.

The claim validation numbers are transmitted from the state lottery administrator 40 and stored in the agent database 33 under control of the data process unit 39. The agent server 30 also provides the claim validation numbers to the player terminals 10 of the winning players. Upon receiving the claim validation numbers, the winning players are qualified to claim predetermined lottery awards. That is, the winning players can obtain a print of claim form including the claim validation numbers at the player terminals 10, and then claim the predetermined lottery awards by completing and submitting the claim form to the state lottery administrator 40. Upon receiving the claim form with the claim validation numbers, the state lottery administrator 40 accesses the corresponding claim validation numbers previously stored in the state database 42 to verify the claim form and the claim validation numbers received. After successful verification of the claim form and the claim validation numbers, the state lottery administrator 40 allows a banking server 50 to reward the predetermined lottery awards under control of the data process unit 39 to the claimants, i.e., the winning players.

A gaming system of the present invention further includes a banking server 50 for crediting and debiting the accounts of the lottery players. The accounts for the use of playing lottery games may be credit card accounts or bank accounts of the lottery players, or separate accounts previously established for the lottery players. Such accounts may be stored in a database 51 of the banking server 50. The banking server 50 credits the accounts of the respective lottery players who own the winning tickets and claim predetermined lottery awards, and debits the accounts of the respective lottery players for the purchases of the lottery tickets. At the time of every credit or debit, the banking server 50 updates the corresponding accounts in the banking database 51. The banking server 50 may directly communicate with credit card providers 53 of the lottery players. That is, the banking server 50 debits and credits credit card accounts of the lottery players upon purchases of the lottery tickets or wins from the lottery tickets purchased.

A Lotto game consists of a player selecting a selecting a set of patterns or numbers that are matched to a random drawing. A payout table establishes the economics of the game by defining the winning combinations and prize for each match. An instant lottery game is based on the same concepts except that the drawing is instant after the ticket is purchased or the drawings and outcomes were predetermined.

An Instant lottery game can consist of the following elements: game graphics and sounds, an Animation Algorithm, a Game Unit 63, and a random number generator (RNG) 62. The Game Unit 63 produces the instant tickets and consists of a Game Algorithm 63*a*, a Payout Table 63*b*, and Ticket Control 63*c*. The Game Algorithm 63*a* defines the type of game being played including whether it is a Predetermined Game 61 or Randomly Generated 62. The Payout Table defines the number of winning combinations and prize amounts per frequency of play and establishes the overall economics of the game. The Game Algorithm 63*a* initiates a randomly generated game result consistent with the Payout Table 63*b*, matches the winning pattern to the player's selections and determines whether the player's selection is a winner and if so the corresponding prize amount according to the Payout Table 63*b*. Ticket Control 63*c* assigns a serial number to all game results generated by the Game Unit 63.

The Game Algorithm 63*a* can also serve Predetermined Tickets 61. In this case, the game results are produced in advance for a fixed supply of tickets in accordance with the Payout Table 63*b*. Each ticket is assigned a serial number by Ticket Control 63*c*.

A player is able to select instant tickets from his Player Terminal 10 that are then submitted to the Game Server 37. When a lottery player selects an instant game to play the game graphics and Animation Algorithms are downloaded to their Player Terminal 10 from the Game Server 37. When a lottery player purchases a game, the ticket information is transmitted to the state lottery administrator 40 under the control of the data process unit 39. The Game Unit 63 produces the instant ticket, determines whether the player has selected a winning pattern and the amount of the prize. The Game Unit 63 assigns a serial number to the instant ticket just generated consisting of the pattern selected by the player, the pattern selected by the random number generator, the winning combinations, the prize amount if any. This ticket and the serial number are stored in database 42. Each of the serial numbers is associated with each of the lottery tickets to be purchased. That is, each serial number is unique to each lottery ticket to be purchased. The serial numbers are then transmitted to and stored in the agent database 33 under the control of the data process unit 39.

The Game Unit 63 sends the results of the game back to the Game Server 37 which in turn sends the results to the Player Terminal 10 along with a unique game validation number. Results include identification of the winning pattern, the amount of the prize and the match with the player's submission. The Player Terminal 10 receives the results and initiates the animation and graphics as dictated by the game results. The game validation number is also stored by the Player Terminal and is the cross reference between the game information stored on the Player Terminal and the game information is stored in the states database 42.

The Game Unit 63 can play a plurality of games. Some games may contain predetermined out comes 61. In that case, the validation number is computed and matched with the game outcome as the games are initially generated. This can be thought of as a ticket roll with winning tickets dispersed through out the roll. The player in effect requests the next ticket on the roll from the Game Unit 63 and roll of Predetermined Tickets 61. The Game Unit then sends the ticket results along with the validation number to Game Server 37 and to Player Terminal 10.

The Game Unit 63 can also produce games whose outcomes are randomly generated by a Random Number Generator 62 when requested by the Player Terminal 10. In this case, the validation number is generated once the game play result is completed by the Game Unit 63. The Game Unit 63 then sends the game results along with the validation number to the Game Server 37 and then to the Player Terminal 10.

Data exchanged between the Game Unit 63, the Game Server 37 and the Player Terminal 10 is encrypted.

In order for a player to claim a prize for a winning ticket, the ticket and the validation number must be presented. The Verification Unit 35 will verify that the ticket is in fact a winner and the amount of the prize. Then the prize can either be credited to the players account. For large prizes, a claim notice can be prepared for collection at a state lottery office. The Prize claim notice will include the name of the player, the ticket number and the validation number. The state at its office can validate the information against the master data to verify it is a winner.

Having described preferred embodiments of a novel interactive computer gaming system (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A remotely accessed gaming system comprising:

at least one gaming location including a plurality of kiosks, wherein each kiosk comprises a display and an input device, the kiosks being connected on a local area network;

a central station remotely disposed relative to the at least one gaming location, the central station configured to connect to the local area network via the Internet to facilitate on-line game play to the gaming location; the central station further comprises a game server configured to generate game play tickets or cards for interactive play on the plurality of kiosks;

a state lottery computer for providing state sponsored games including state lottery; and an agent server connected to the state lottery computer and configured to connect to the gaming location via the Internet to facilitate online state lottery play at the gaming location.

2. The system of claim 1, wherein the game server is further configured to generate game play tickets or cards according to a game play algorithm and to receive game play responses entered at the input device of the kiosk by a participating player.

3. The system of claim 1, wherein the state lottery computer is configured to control the state lottery the agent server without direct communication to the gaming location.

4. The system of claim 1, wherein the central station further includes a business server configured to receive player account information and to update player accounts responsive to requests for participating and winning results as determined at the central station.

5. The system of claim 4, wherein the business server is further configured to store subscription lottery play information corresponding to player accounts.

6. The system of claim 1, wherein the game server is further configured to generate simultaneous play of a game among a plurality of players.

7. The system of claim 6, wherein the game is one of poker or bingo.

8. The system of claim 1, wherein the agent server includes a firewall computer configured to maintain the state lottery computer from direct online access by the plurality of kiosks.

9. The system of claim 1, wherein the tickets generated are either state sponsored or non-state sponsored lottery game.

10. The system of claim 9, wherein the non-state sponsored lottery ticket pertains to an instant drawing, and wherein results are transmitted directly to the displays on the kiosk.

11. An online gaming system, comprising:

a plurality of gaming terminals, each comprising a processor, a display, a memory, a keyboard and a telephone;

a game server configured to generate game play for interactive play on the plurality of gaming terminals;

a web server connected to the game server, wherein the web server is configured to provide the game play for interactive play on the plurality of gaming terminals via the internet;

a state lottery computer for providing state sponsored games including state lottery; and an agent server connected to the state loner computer and configured to connect to the gaming terminals via the Internet to facilitate online state lottery play at the gaming terminals.

12. The system of claim 11, wherein the telephone of the gaming terminal is configured to connect to a telephone network to access the web server.

13. The system of claim 11, wherein the game server is further configured to generate game play tickets or cards according to a game play algorithm and to receive game play responses entered at the keyboard of the gaming terminal by a participating player.

14. The system of claim 11, wherein the gaming server is connected via a LAN to a central station, which in turn is connected via the LAN to a business server configured to receive player account information and to update player accounts responsive to requests for participating and winning results as determined at the central station.

15. The system of claim 11, wherein the agent server includes a firewall computer configured to maintain the state lottery computer from direct online access by the gaming terminals.

16. The system of claim 11, wherein the game server is further configured to generate simultaneous play of a single game among a plurality of players.

17. The system of claim 16, wherein the game is one of poker or bingo.

18. The system of claim 13, wherein the tickets generated are either state sponsored or non-state sponsored lottery game.

19. An online lottery system, comprising:

a plurality of gaming terminals, each comprising a processor, a display, a memory, a keyboard and a telephone;

a game server configured to generate lottery game play;

a web server connected to the game server, wherein the web server is configured to provide the game play for interactive play on the plurality of gaming terminals via the internet; and a governmental lottery server configured to connect to the game server, the governmental lottery server is configured to receive and store lottery ticket information and associated serial numbers issued by a governmental entity.

20. The system of claim 19, wherein the telephone of the gaming terminal is configured to connect to a telephone network to access the web server.

21. An online lottery system, comprising:

a plurality of gaming terminals, each comprising a processor, a display, a memory, a keyboard and a telephone;

a web server configured to provide interactive game play on the plurality of gaming terminals via the internet;

a state lottery computer configured to provide state lottery play; and an agent server configured to connect to the plurality of gaming terminals via the internet and to interface to the state lottery computer to facilitate online state lottery play at the gaming terminals, wherein the telephone of the gaming terminal is configured to access the internet.

22. The system of claim 21, wherein the agent server includes a firewall computer configured to provide a secured interface to the state lottery computer.

23. The system of claim 21, wherein the telephone is configured to connect to a telephone network to access the internet.

24. The system of claim 21, wherein the interactive game play includes one of poker, pick-3, or blackjack.

* * * * *